US008737897B2

(12) United States Patent
Egi

(10) Patent No.: US 8,737,897 B2
(45) Date of Patent: May 27, 2014

(54) FIXING DEVICE AND IMAGE FORMING APPARATUS

(71) Applicant: KYOCERA Document Solutions Inc., Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 73 days.

(21) Appl. No.: 13/622,719

(22) Filed: Sep. 19, 2012

(65) Prior Publication Data

US 2013/0071154 A1 Mar. 21, 2013

(30) Foreign Application Priority Data

Sep. 21, 2011 (JP) ..... 2011-206200

(51) Int. Cl.
*G03G 15/20* (2006.01)

(52) U.S. Cl.
USPC ..... 399/329; 399/328

(58) Field of Classification Search
None
See application file for complete search history.

(56) References Cited

U.S. PATENT DOCUMENTS

2002/0031380 A1 3/2002 Sato
2009/0245897 A1 * 10/2009 Seo et al. ..... 399/328

FOREIGN PATENT DOCUMENTS

JP 10074009 3/1998
JP 2002083676 3/2002

* cited by examiner

*Primary Examiner* — Clayton E Laballe
*Assistant Examiner* — Jas Sanghera
(74) *Attorney, Agent, or Firm* — Frommer Lawrence & Haug LLP

(57) ABSTRACT

A fixing device includes a pressing rotating body, a heating rotating belt, an induction coil, a magnetic core portion, and a belt guide member. The belt guide member is disposed on the inner side of the heating rotating belt and includes a coil side section that is disposed toward the induction coil relative to a rotational axis of the heating rotating belt and includes a temperature-rise corresponding portion and a non temperature-rise corresponding portion, and a nip side section that is disposed toward the pressing rotating body relative to the rotational axis and includes a paper-passing corresponding portion and a heat transfer portion disposed on the outer side of the paper-passing corresponding portion and having thermal conductivity higher than the thermal conductivity of the paper-passing corresponding portion.

16 Claims, 10 Drawing Sheets

FIXING DEVICE AND IMAGE FORMING APPARATUS

INCORPORATION BY REFERENCE

This application is based upon and claims the benefit of priority from the corresponding Japanese Patent application No. 2011-206200, filed Sep. 21, 2011, the entire contents of which are incorporated herein by reference.

FIELD

The present disclosure relates to a fixing device and an image forming apparatus including the fixing device.

BACKGROUND

In the field of image forming apparatuses, a fixing device having a fixing belt that can reduce the heat capacity of the fixing device has been attracting attention. In recent years, an electromagnetic induction heating type fixing device capable of rapid heating and high-efficiency heating has been attracting attention.

In an electromagnetic induction heating type fixing device, it is advantageous to suppress an excessive temperature rise in a heating rotating body in regions on the outer side of a paper-passing region through which paper passes (non paper-passing regions) according to the width of paper as a receiving material transported to (passed through) the fixing device (the width of paper in a direction perpendicular to the paper transport direction: paper passing width). For this purpose, there has been proposed a technology concerned with a fixing device that adjusts the amounts of heat generation of the heating rotating body in the non paper-passing regions and the paper-passing region.

The fixing device in the proposed technology includes a heating rotating body, a pressing rotating body, an induction coil that generates magnetic flux, a magnetic core portion, a magnetic flux blocking member that reduces or blocks the magnetic flux generated by the induction coil, and a moving mechanism that moves the magnetic flux blocking member. In the technology, an excessive temperature rise in the non paper-passing regions of the heating rotating body can be suppressed by moving the magnetic flux blocking member corresponding to the paper passing width of paper to be passed and adjusting the amount of magnetic flux passing through the magnetic core portion.

However, in the above mentioned fixing device, the temperature of the non paper-passing regions sometimes rises excessively when small size paper is passed, and image offset sometimes occurs in the formed image when printing is performed on large size paper after continuous printing on small size paper. In the case in which adjustment is performed so that the temperature of the non paper-passing regions of small size paper does not rise excessively, when the temperature of the non paper-passing regions of the small size paper becomes too low after continuous printing on small size paper, unsatisfactory fixation may occur when large size paper is passed after that. This problem can also occur when in the above fixing device, in place of the heating rotating body, a heating rotating belt that can reduce the heat capacity of the fixing device is used.

SUMMARY

A fixing device according to an aspect of some embodiments of the present disclosure includes a pressing rotating body, a heating rotating belt having an inner surface and an opposite outer surface, an induction coil, a magnetic core portion, and a belt guide member. The heating rotating belt is disposed such that the outer surface faces the pressing rotating body. The heating rotating belt forms a fixing nip between the outer surface and the pressing rotating body, and is rotationally driven about a rotational axis by the rotation of the pressing rotating body. The induction coil is disposed so as to face the outer surface of the heating rotating belt in a radial direction of the heating rotating belt and generates magnetic flux. The magnetic core portion forms a magnetic path of the magnetic flux generated by the induction coil. The belt guide member is disposed on the inner surface of the heating rotating belt in the radial direction of the heating rotating belt. The belt guide member is in contact with at least a part of the inner surface of the heating rotating belt to position the heating rotating belt, and to guide the rotation of the heating rotating belt. The belt guide member includes a coil side section that is disposed toward the induction coil relative to the rotational axis and a nip side section that is disposed toward the pressing rotating body relative to the rotational axis. The coil side section includes a temperature-rise corresponding portion and a non temperature-rise corresponding portion disposed on the outer side of the temperature-rise corresponding portion in a width direction of the heating rotating belt. The nip side section includes a paper-passing corresponding portion corresponding to a paper-passing region through which a receiving material passes and a heat transfer portion disposed on the outer side of the paper-passing corresponding portion in the width direction of the heating rotating belt. The heat transfer portion has thermal conductivity higher than that of the paper-passing corresponding portion.

An image forming apparatus according to another aspect of some embodiments of the present disclosure includes an image bearing member on which an electrostatic latent image is formed, a developing device that develops the electrostatic latent image formed on the image bearing member into a toner image, a transfer portion that transfers the toner image formed on the image bearing member to a receiving material, and a fixing device that fixes the toner image transferred to the receiving material, to the receiving material. The fixing device includes a pressing rotating body, a heating rotating belt having an inner surface and an opposite outer surface, an induction coil, a magnetic core portion, and a belt guide member. The heating rotating belt is disposed such that the outer surface faces the pressing rotating body. The heating rotating belt forms a fixing nip between the outer surface and the pressing rotating body, and is rotationally driven about a rotational axis by the rotation of the pressing rotating body. The induction coil is disposed so as to face the outer surface of the heating rotating belt in a radial direction of the heating rotating belt and generates magnetic flux. The magnetic core portion forms a magnetic path of the magnetic flux generated by the induction coil. The belt guide member is disposed on the inner surface of the heating rotating belt in the radial direction of the heating rotating belt. The belt guide member is in contact with at least a part of the inner surface of the heating rotating belt to position the heating rotating belt, and to guide the rotation of the heating rotating belt. The belt guide member includes a coil side section that is disposed toward the induction coil relative to the rotational axis and a nip side section that is disposed toward the pressing rotating body relative to the rotational axis. The coil side section includes a temperature-rise corresponding portion and a non temperature-rise corresponding portion disposed on the outer side of the temperature-rise corresponding portion in a width direction of the heating rotating belt. The nip side section includes a paper-passing corresponding portion corresponding to a paper-passing region through which the receiving material passes and a heat transfer portion disposed on the outer side of the paper-passing corresponding portion in a width direction of the heating rotating belt. The heat transfer portion has thermal conductivity higher than that of the paper-passing corresponding portion.

The above and other objects, features, and advantages of various embodiments of the present disclosure will be more apparent from the following detailed description of embodiments taken in conjunction with the accompanying drawings.

Throughout the specification and claims, the following terms take at least the meanings explicitly associated herein, unless the context dictates otherwise. The meanings identified below do not necessarily limit the terms, but merely provide illustrative examples for the terms. In the text, the terms "comprising", "comprise", "comprises" and other forms of "comprise" can have the meaning ascribed to these terms in U.S. Patent Law and can mean "including", "include", "includes" and other forms of "include." The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

It will be appreciated by those skilled in the art that the foregoing brief description and the following detailed description are exemplary (i.e., illustrative) and explanatory of the subject matter of the present disclosure, but are not intended to be restrictive thereof or limiting of the advantages which can be achieved by the present disclosure in various implementations. Additionally, it is understood that the foregoing summary and ensuing detailed description are representative of some embodiments of the present disclosure, and are neither representative nor inclusive of all subject matter and embodiments within the scope of the present disclosure. Thus, the accompanying drawings, referred to herein and constituting a part hereof, illustrate embodiments of this disclosure, and, together with the detailed description, serve to explain principles of embodiments of the present disclosure.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Figure 1:
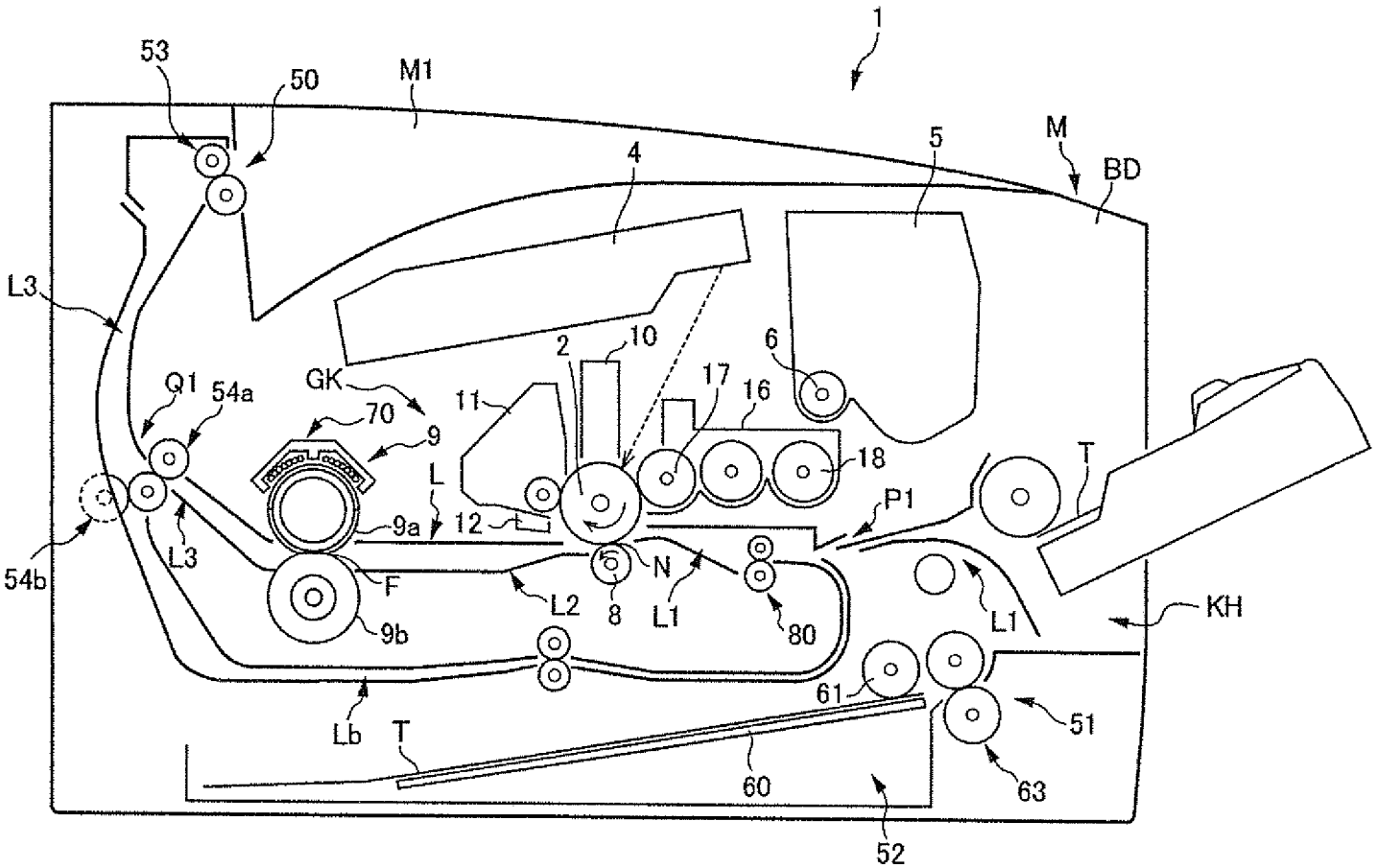
FIG. 1 is a diagram for illustrating a printer of a first embodiment of the present disclosure.

The overall structure of a printer 1 as an image forming apparatus of a first illustrative embodiment will be described with reference to FIG. 1. FIG. 1 is a diagram for illustrating the printer 1 of the first embodiment of the present disclosure. In the following description, for ease of reference, the top-bottom direction in FIG. 1 is sometimes simply referred to as "vertical direction."

As shown in FIG. 1, the printer 1 of the first embodiment includes an apparatus main body M. The apparatus main body M includes an image forming portion GK and a paper feeding and ejecting portion KH. The image forming portion GK forms a toner image on paper T as a receiving material on the basis of image information. The paper feeding and ejecting portion KH feeds the paper T to the image forming portion GK and ejects the paper T on which a toner image is formed. The outer shape of the apparatus main body M is defined by a ease body BD as a case.

As shown in FIG. 1, the image forming portion GK includes a photosensitive drum 2 as an image bearing member (photosensitive member), a charging portion 10, a laser scanner unit 4 as an exposure unit, a developing device 16, a toner cartridge 5, a toner feed portion 6, a drum cleaning portion 11, a neutralization device 12, a transfer roller 8 as a transfer portion, and a fixing device 9.

As shown in FIG. 1, the paper feeding and ejecting portion KH includes a paper cassette 52, a transport path L for transporting the paper T, a registration roller pair 80, and a paper ejecting portion 50.

The configurations of the image forming portion GK and the paper feeding and ejecting portion KH will be described in detail below.

First, the image forming portion GK will be described. In the image forming portion GK, in order along the surface of the photosensitive drum 2, in order from the upstream side to the downstream side along the rotation direction of the photosensitive drum 2 indicated by an arrow in FIG. 1, charging by the charging portion 10, exposure by the laser scanner unit 4, development by the developing device 16, transfer by the transfer roller 8, neutralization by the neutralization device 12, and cleaning by the drum cleaning portion 11 are performed.

The photosensitive drum 2 is a cylindrical member and functions as the photosensitive member or the image bearing member. The photosensitive drum 2 is rotatable in the direction indicated by the arrow in FIG. 1 about a rotating axis extending in a direction perpendicular to the transport direction paper T in the transport path L. An electrostatic latent image can be formed on the surface of the photosensitive drum 2.

The charging portion 10 is disposed so as to face the surface of the photosensitive drum 2. The charging portion 10 charges the surface of the photosensitive drum 2 uniformly negatively or positively.

The laser scanner unit 4 functions as the exposure unit and is disposed away from the surface of the photosensitive drum 2.

The laser scanner unit 4 can form an electrostatic latent image on the surface of the photosensitive drum 2 by scanning and exposing the surface of the photosensitive drum 2 on the basis of image information input from an external device such as a PC (personal computer).

The developing device 16 is disposed so as to face the surface of the photosensitive drum 2. The developing device 16 develops the electrostatic latent image formed on the photosensitive drum 2 using monochrome (usually black) toner, and forms a monochrome toner image on the surface of the photosensitive drum 2. The developing device 16 includes a developing roller 17 disposed so as to face the surface of the photosensitive drum 2 and an agitating roller 18 for agitating toner.

The toner cartridge 5 is provided in correspondence with the developing device 16 and stores toner to be fed to the developing device 16.

The toner feed portion 6 is provided in correspondence with the toner cartridge 5 and the developing device 16 and feeds the toner stored in the toner cartridge 5 to the developing device 16.

The transfer roller 8 transfers the toner image formed on the surface of the photosensitive drum 2 to the paper T. The transfer roller 8 is rotatable in contact with the photosensitive drum 2.

A transfer nip N is formed between the photosensitive drum 2 and the transfer roller 8. At the transfer nip N, the toner image formed on the photosensitive drum 2 is transferred to the paper T. The neutralization device 12 is disposed so as to face the surface of the photosensitive drum 2. The drum cleaning portion 11 is disposed so as to face the surface of the photosensitive drum 2.

The fixing device 9 fuses and presses the toner forming the toner image transferred to the paper T to fix the toner to the paper T. The details of the fixing device 9 will be described later.

Next, the paper feeding and ejecting portion KH will be described. As shown in FIG. 1, the paper cassette 52 storing paper T is disposed in the lower part of the apparatus main body M. A placing plate 60 on which paper T is stacked is disposed in the paper cassette 52. The paper T stacked on the placing plate 60 is sent out to the transport path L by a cassette feed portion 51. The cassette feed portion 51 includes a multi-feed prevention mechanism including a forward feed roller 61 for taking out the paper T on the placing plate 60 and a feed roller pair 63 for sending out the paper T one by one to the transport path L.

The paper ejecting portion 50 is provided in the upper part of the apparatus main body M. The paper ejecting portion 50 ejects the paper T with a third roller pair 53 to the outside of the apparatus main body M. The details of the paper ejecting portion 50 will be described later.

The transport path L for transporting the paper T includes a first transport path L1 from the cassette feed portion 51 to the transfer nip N, a second transport path L2 from the transfer nip N to the fixing device 9, a third transport path L3 from the fixing device 9 to the paper ejecting portion 50, and a return transport path Lb for reversing paper T transported through the third transport path L3 from the upstream side to the downstream side and returning the reversed paper T to the first transport path L1.

A first merging portion P1 is provided in the first transport path L1. A first branching portion Q1 is provided in the third transport path L3. The first branching portion Q1 is a branching portion where the return transport path Lb branches from the third transport path L3, and has a first roller pair 54*a* and a second roller pair 54*b*. One of the first roller pair 54*a* doubles as one of the second roller pair 54*b*.

A sensor (not shown) for detecting the paper T and the registration roller pair 80 are disposed in the first transport path L1 (specifically, between the first merging portion P1 and the transfer nip N). The registration roller pair 80 corrects the skew (oblique feeding) of the paper T and matches the timing of the formation of a toner image in the image forming portion GK with the timing of the transportation of the paper T.

The paper ejecting portion 50 is disposed at the downstream end of the third transport path L3 in the transport direction of paper T. The paper ejecting portion 50 is disposed in the upper part of the apparatus main body M. The paper ejecting portion 50 ejects the paper T transported through the third transport path L3 with the third roller pair 53 to the outside of the apparatus main body M.

An ejected paper accumulating portion M1 is disposed adjacent to the opening of the paper ejecting portion 50. The ejected paper accumulating portion M1 is provided on the upper surface (outer surface) of the apparatus main body M. A sensor (not shown) for detecting paper is disposed at a predetermined position in each transport path.

Figure 2:
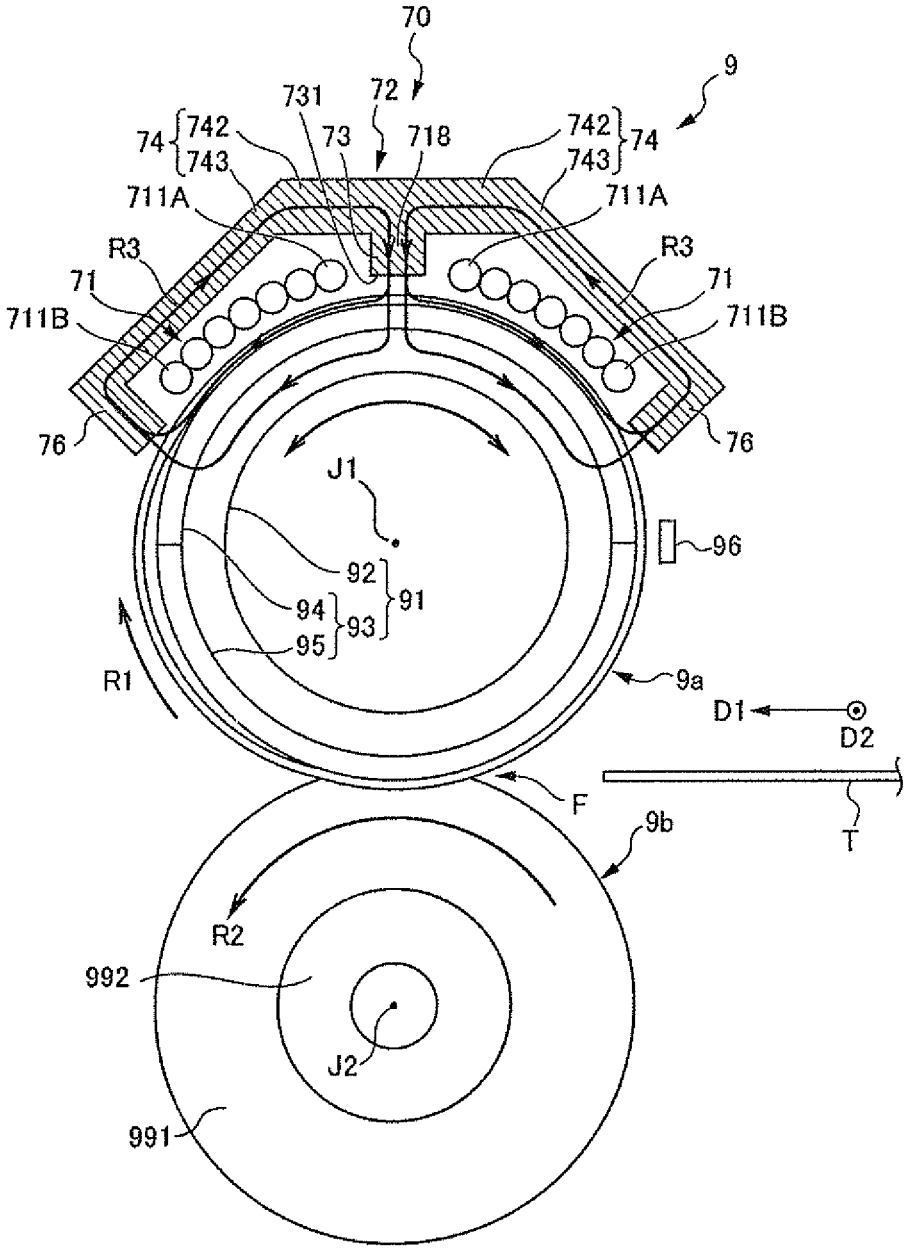
FIG. 2 is a sectional view for illustrating a fixing device of the printer of the first embodiment.
Figure 3:
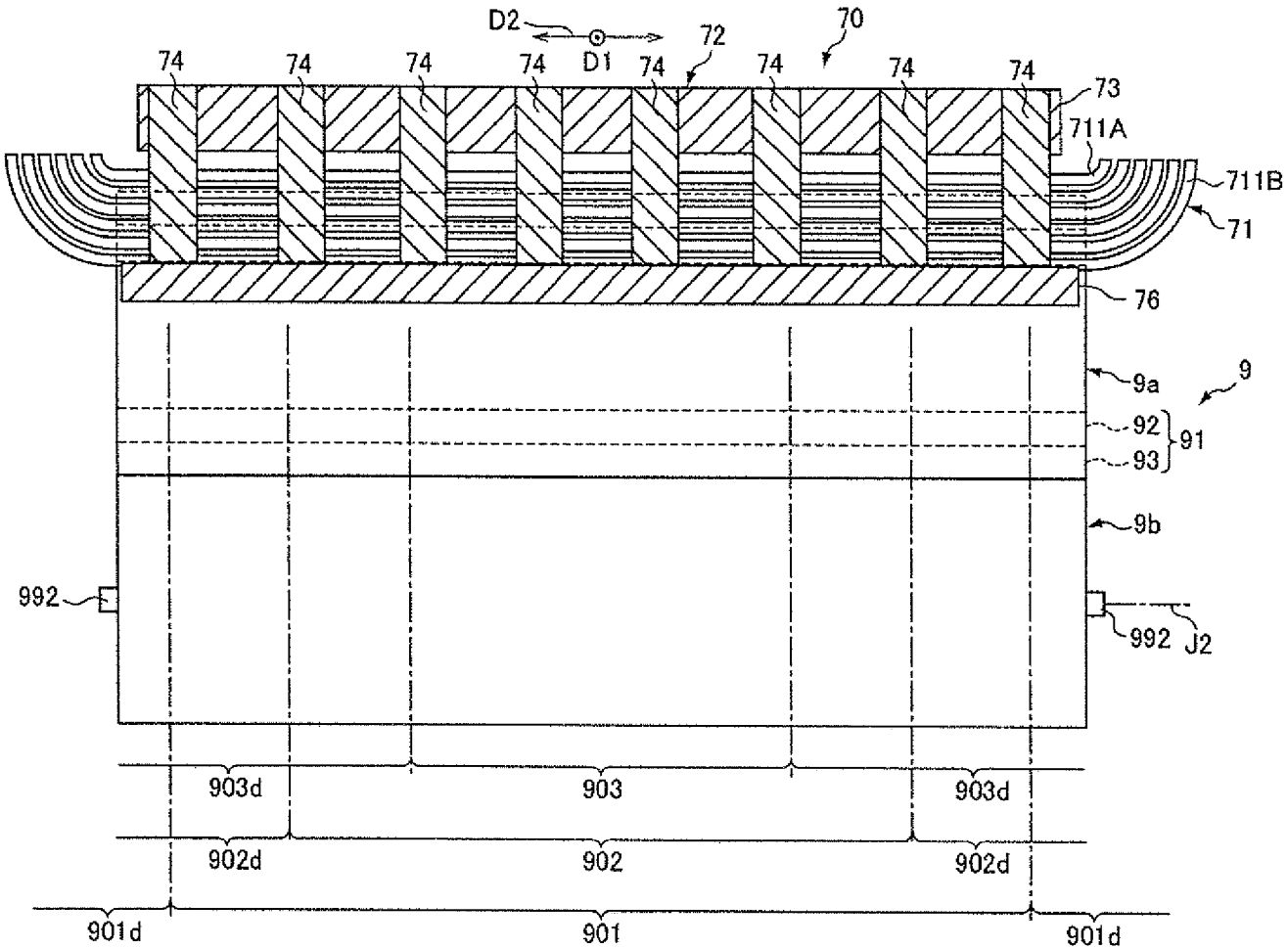
FIG. 3 illustrates the fixing device shown in FIG. 2 viewed from a direction in which paper is transported.
Figure 4:
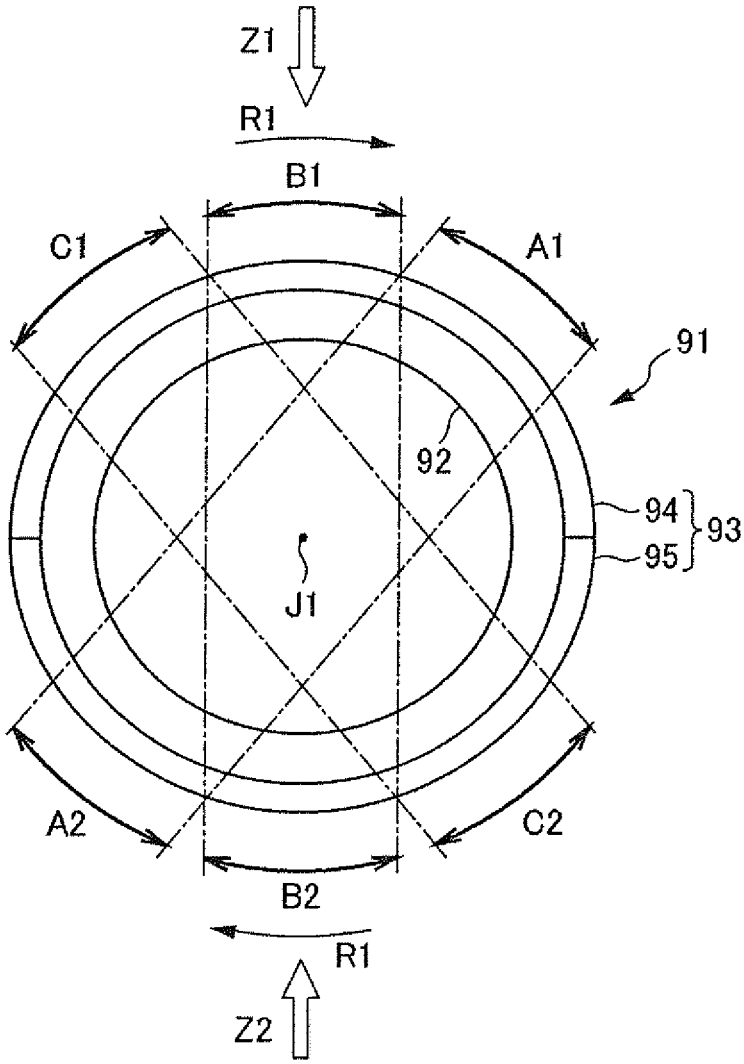
FIG. 4 is a sectional view showing the configuration of a belt guide member of the first embodiment.
Figure 5:
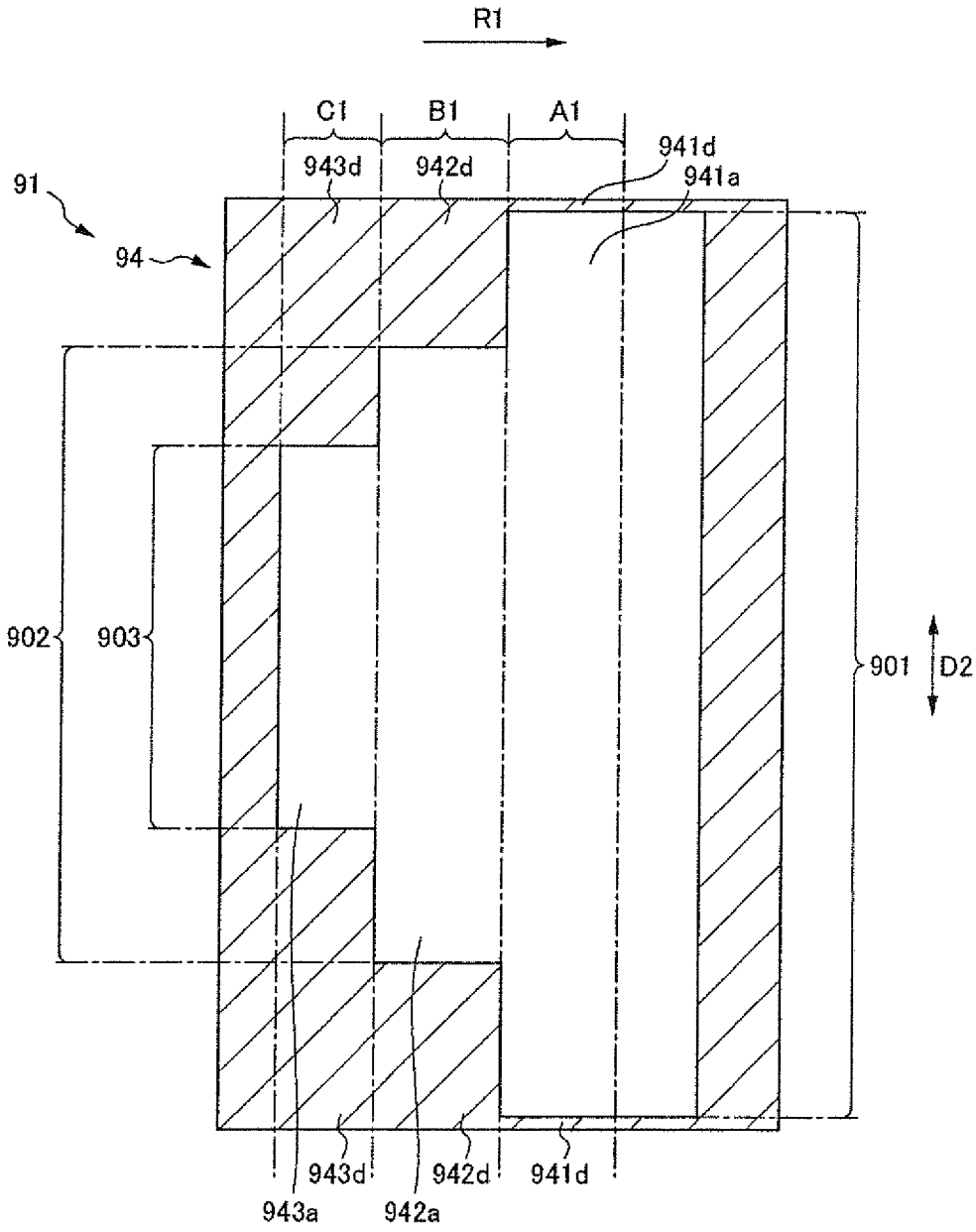
FIG. 5 illustrates the belt guide member shown in FIG. 4 viewed from a Z1 direction.
Figure 6:
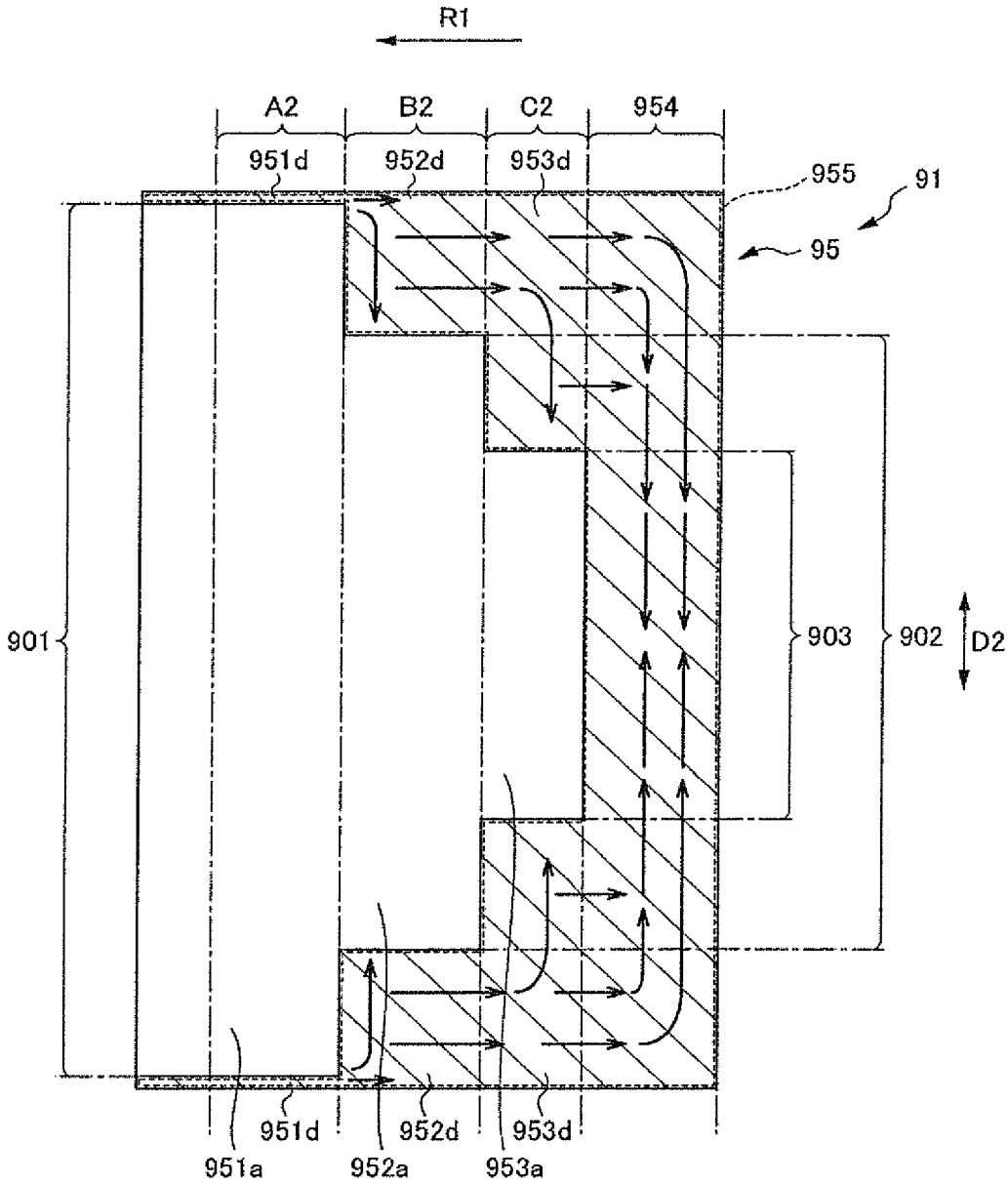
FIG. 6 illustrates the belt guide member shown in FIG. 4 viewed from a Z2 direction.

Next, the fixing device 9, which is a characterizing portion of the printer 1 of this illustrative embodiment, will be described in detail. FIG. 2 is a sectional view for illustrating the fixing device 9 of the printer 1 of the first embodiment, which is illustrative of some embodiments of the present disclosure. FIG. 3 illustrates the fixing device 9 shown in FIG. 2 viewed from a direction D1 in which the paper T is transported. FIG. 4 is a sectional view showing the configuration of a belt guide member 91 of the first embodiment. FIG. 5 illustrates the belt guide member 91 shown in FIG. 4 viewed from a Z1 direction. FIG. 6 illustrates the belt guide member 91 shown in FIG. 4 viewed from a Z2 direction.

As shown in FIG. 2, the fixing device 9 includes a heating rotating belt 9*a* having an inner surface and an opposite outer surface, a pressing roller 9*b* as a pressing rotating body pressed against (in contact with) the outer surface of the heating rotating belt 9*a*, a heating unit 70, a belt guide member 91, and a temperature sensor 96.

The heating rotating belt 9*a* is annular (like an endless belt) as viewed from the direction of rotational axis J1 thereof (referred to below as the first rotational axis J1). The heating rotating belt 9*a* is a belt having a small heat capacity. The heating rotating belt 9*a* generates heat by electromagnetic induction heating utilizing electromagnetic induction, by using the heating unit 70 to be described later.

The heating rotating belt 9*a* is rotatable in a first circumferential direction (rotation direction) R1 about a first rotational axis J1 parallel to a direction D2 perpendicular to the first circumferential direction R1. The heating rotating belt 9*a* has a predetermined width in the direction of the first rotational axis J1. In this embodiment, the width direction of the heating rotating belt 9*a*, a perpendicular direction perpendicular to the tangent of the first circumferential direction R1, or the direction of the first rotational axis J1 will be also referred to as "paper width direction D2." The paper width direction D2 corresponds approximately to the direction of the first rotational axis J1.

The belt guide member 91 to be described later is disposed on the inner side of the heating rotating belt 9*a*. The heating rotating belt 9*a* is supported by the cylindrical belt guide member 91, under a predetermined tension. The details of the belt guide member 91 will be described later.

In this embodiment, a substrate of the heating rotating belt 9*a* is formed of a ferromagnetic material such as nickel. The heating rotating belt 9*a* is disposed in a region through which magnetic flux generated by an induction coil 71 of the heating unit 70 to be described later passes, and the substrate thereof is fowled of a ferromagnetic material. Thus, the heating rotating belt 9*a* forms magnetic paths of the magnetic flux generated by the induction coil 71. The magnetic flux generated by the induction coil 71 passes (is guided) along the heating rotating belt 9*a* forming the magnetic paths. In this embodiment, the heating rotating belt 9*a* further includes an elastic layer formed on the outer circumferential surface of the substrate, and a release layer formed on the outer circumferential surface of the elastic layer.

In this embodiment, the thickness of the substrate of the heating rotating belt 9*a* is set to such a thickness that the magnetic flux generated by the induction coil 71 can penetrate (i.e., can pass entirely through) the substrate.

In the substrate of the heating rotating belt 9*a*, an eddy current (induced current) is generated by electromagnetic induction due to magnetic flux that does not penetrate (i.e., does not pass entirely through) the substrate of the heating rotating belt 9*a* and that passes along the substrate. Since the eddy current flows in the substrate, Joule heat is generated with the electrical resistance of the substrate. In this way, the substrate of the heating rotating belt 9*a* generates heat by electromagnetic induction heating utilizing electromagnetic induction due to the magnetic flux from the heating unit 70 to be described later.

In this embodiment, the pressing roller 9*b* is cylindrical (annular in cross-section). The pressing roller 9*b* is disposed vertically below the heating rotating belt 9*a* so as to face the outer surface of the heating rotating belt 9*a*. The pressing roller 9*b* is rotatable in a second circumferential direction R2 about a second rotational axis J2 that is parallel to the paper width direction D2. The second rotational axis J2 is parallel to the first rotational axis J1. The pressing roller 9*b* is elongated in the direction of the second rotational axis J2.

The pressing roller 9*b* is disposed such that the outer circumferential surface thereof is in contact with the outer circumferential surface (outer surface) of the heating rotating belt 9*a*. The pressing roller 9*b* is disposed so as to press the belt guide member 91 (to be described later) with the heating rotating belt 9*a* therebetween. Part of the heating rotating belt 9*a* is sandwiched between the pressing roller 9*b* and the belt guide member 91, and a fixing nip F is formed between the pressing roller 9*b* and the outer surface of the heating rotating belt 9*a*. At the fixing nip F, the paper T is nipped and transported.

The pressing roller 9*b* includes a pressing roller main body 991 and a pair of shaft members 992 (see FIG. 2 and FIG. 3) coaxial with the second rotational axis J2. The pressing roller main body 991 includes a cylindrical metal member, an elastic layer formed on the outer circumferential surface of the metal member, and a release layer formed on the outer circumferential surface of the elastic layer.

One of the shaft members 992 of the pressing roller 9*b* is connected to a rotationally driving portion (not shown) that rotationally drives the pressing roller 9*b*. The rotationally driving portion rotationally drives the pressing roller 9*b* in the second circumferential direction R2 at a predetermined speed. The heating rotating belt 9*a*, which is in contact with the outer circumferential surface of the pressing roller 9*b*, is rotationally driven by the rotation of the pressing roller 9*b*.

Since the heating rotating belt 9*a* is rotationally driven by the rotation of the pressing roller 9*b*, tension due to the rotation of the pressing roller 9*b* acts on the heating rotating belt 9*a*, and the inner circumferential surface of the heating rotating belt 9*a* comes into contact with the outer circumferential surface of the belt guide member 91, on the upstream side of the fixing nip F in the rotation direction R1 of the heating rotating belt 9*a*.

When the paper T transported to the fixing nip F passes through a paper-passing region of the fixing device 9, the toner image is fixed to the paper T. The term "paper-passing region" means a region through which the paper T transported to the fixing nip F passes while being nipped between the heating rotating belt 9*a* and the pressing roller 9*b* when the paper T is transported to the fixing nip F. Regions that are located on the outer side of the paper-passing region in the paper width direction D2 and through which the paper T does not pass are referred to as "non paper-passing regions." The non paper-passing regions are set according to paper T of a plurality of sizes.

As shown in FIG. 3, a maximum paper-passing region 901 is set as a paper-passing region in the case where the paper T having the maximum length in the paper width direction D2 is transported to the fixing nip F. The maximum paper-passing region 901 is set for each printer 1. The regions on the outer side of the maximum paper-passing region 901 in the paper width direction D2 are maximum non paper-passing regions 901*d*.

A minimum paper-passing region 903 is set as a paper-passing region in the case where the paper T having the minimum length in the paper width direction D2 is transported to the fixing nip F. The regions on the outer side of the minimum paper-passing region 903 in the paper width direction D2 are minimum non paper-passing regions 903*d* (though these "minimum non paper-passing regions" are wider than the "maximum non paper-passing region," for ease of reference, the terminology used in this illustrative embodiment to specifies the particular non paper-passing region according to the same nomenclature used for referencing the corresponding paper-passing region).

In the fixing device 9 of this embodiment, an intermediate paper-passing region 902 is set as a paper-passing region in the ease where the paper T having an intermediate length (intermediate width), that is, a length in the paper width direction D2 shorter than the maximum length and longer than the minimum length (minimum width) is transported to the fixing nip F. The regions on the outer side of the intermediate paper-passing region 902 in the paper width direction D2 are intermediate non paper-passing regions 902*d*. The paper-passing regions for the paper T are not limited to these and can be set according to the sizes of the paper T.

The heating unit 70 according to some embodiments such as the present illustrative embodiment will now be described. As shown in FIG. 2 and FIG. 3, the heating unit 70 includes the induction coil 71 and a magnetic core portion 72.

The induction coil 71 is spaced away from the outer circumferential surface of the heating rotating belt 9*a* by a predetermined distance (in the radial direction with respect to the first rotational axis J1 of the heating rotating belt 9*a*; i.e., in the direction perpendicular to and with reference to the first rotational axis J1) and is disposed along the outer circumferential surface of the heating rotating belt 9*a*. In this embodiment, the induction coil 71 is formed in such a shape that a wire is preliminarily wound. The induction coil 71 is disposed in the heating unit 70 such that the longitudinal direction thereof is parallel to the paper width direction D2. The induction coil 71 may also be formed by winding a wire in a shape elongated in the paper width direction D2 in plan view (as viewed from above in FIG. 2).

The induction coil 71 is longer than the heating rotating belt 9*a* in the paper width direction D2. The induction coil 71 is disposed so as to face the outer circumferential surface of the vertically upper part of the heating rotating belt 9*a* in the radial direction of the heating rotating belt 9*a*. The induction coil 71 is disposed so as to surround a central region 718 extending in the paper width direction D2. The central region 718 is a region elongated in the paper width direction D2 that is located over the vertically uppermost part of the heating rotating belt 9*a* (the approximately central part of the heating rotating belt 9*a* in the transport direction D1 of the paper T) and in which the wire of the induction coil 71 is not disposed.

In this embodiment, the induction coil 71 is formed such that when the induction coil 71 is disposed in the heating unit 70, the induction coil 71 is disposed as follows. The inner periphery of the induction coil 71 (the part where the wire 711A is disposed) surrounds the central region 718. The wire forming the induction coil 71 extends in the paper width direction D2. The wire forming the induction coil 71 is arranged from the inner periphery of the induction coil 71 along the circumferential direction of the heating rotating belt 9*a*. The outer periphery of the induction coil 71 (the part where the wire 711B is disposed) faces the outer circumferential surface of the heating rotating belt 9*a*.

In this embodiment, the induction coil 71 is fixed to a supporting member (not shown) formed of a heat-resistant resin material.

The induction coil 71 is connected to an induction heating circuit portion (not shown). An alternating current is applied to the induction coil 71 from the induction heating circuit portion. When an alternating current is applied to the induction coil 71 from the induction heating circuit portion, the induction coil 71 generates magnetic flux for causing the heating rotating belt 9*a* to generate heat. For example, an alternating current having a frequency of about 30 kHz is applied to the induction coil 71.

The magnetic flux generated by the induction coil 71 is guided to magnetic paths that are paths for magnetic flux fanned by the heating rotating belt 9*a* and the magnetic core portion 72 (to be described later).

The magnetic paths are formed by the heating rotating belt 9*a* and the magnetic core portion 72 (to be described later) such that the magnetic flux generated by the induction coil 71 circles in a circling direction R3. The circling direction R3 is a direction that passes through the inner side of the inner periphery 711A and the outer side of the outer periphery 711B of the induction coil 71 and circles so as to surround the wire portion of the induction coil 71. The magnetic flux generated by the induction coil 71 passes through the magnetic paths.

Because an alternating current is applied from the induction heating circuit portion (not shown) to the induction coil 71, the magnitude and direction of the magnetic flux generated by the induction coil 71 changes periodically due to periodical change of the alternating current to the positive or negative. The change of the magnetic flux generates an induced current (eddy current) in the heating rotary belt 9*a*.

The magnetic core portion 72 forms magnetic paths circling in the circling direction R3 as shown in FIG. 2. The magnetic core portion 72 is disposed in a region through which the magnetic flux generated by the induction coil 71 passes and is formed mainly of a ferromagnetic material. Thus, the magnetic core portion 72 forms magnetic paths that are paths of the magnetic flux generated by the induction coil 71.

As shown in FIG. 2 and FIG. 3, the magnetic core portion 72 includes a center core portion 73 (first core portion), a plurality of arch core portions 74, and a pair of side core portions 76. The center core portion 73, the arch core portions 74, and the side core portions 76 are formed mainly, for example, of a magnetic core formed by sintering ferrite powder which is a ferromagnetic material.

As shown in FIG. 2, the center core portion 73 is disposed in the vicinity of the inner periphery 711A of the induction coil 71. As viewed from the paper width direction D2, the center core portion 73 is disposed at a position vertically above the heating rotating belt 9*a* and corresponding to the approximately central part of the heating rotating belt 9*a* in the transport direction D1 of the paper T. In other words, the center core portion 73 is disposed in the central region 718, which is a region on the inner side of the inner periphery of the induction coil 71.

The center core portion 73 is disposed between the arch core portions 74 to be described later and the heating rotating belt 9*a* and is joined to the arch core portions 74. The center core portion 73 is disposed away from the outer circumferential surface of the heating rotating belt 9*a* by a predetermined distance without sandwiching the induction coil 71 therebetween. A facing surface 731 that is the lower surface of the center core portion 73 faces the outer circumferential surface of the upper part of the heating rotating belt 9*a*.

As shown in FIG. 3, the center core portion 73 has a substantially rectangular parallelepiped shape that is elongated in the paper width direction D2, and is longer than the maximum paper-passing region 901.

As shown in FIG. 2, the center core portion 73 forms magnetic paths between the arch core portions 74 and the heating rotating belt 9*a* in the circling direction R3 of the magnetic paths.

The plurality of arch core portions 74 are disposed so as to face the outer circumferential surface of the heating rotating belt 9*a* with the center core portion 73 and the wire forming the induction coil 71 therebetween. The plurality of arch core portions 74 are disposed away from the induction coil 71. The plurality of arch core portions 74 are integrally formed above the center core portion 73 and the induction coil 71 so as to be disposed along the outer circumferential surface of the heating rotating belt 9*a*, from the downstream side to the upstream side of the transport direction D1 of the paper T, and extend like arches. The arch core portions 74 each include a horizontal portion 742 and an inclined portion 743.

As shown in FIG. 2, the plurality of arch core portions 74 are disposed at predetermined positions in the paper width direction D2, along the circling direction R3 of the magnetic paths, so as to adjoin the center core portion 73. The plurality of arch core portions 74 form magnetic paths on the opposite side of the induction coil 71 with respect to the heating rotating belt 9*a* (on the outer side of the induction coil 71) in the circling direction R3 of the magnetic paths.

As shown in FIG. 3, the plurality of arch core portions 74 are spaced at predetermined intervals in the paper width direction D2. The plurality of arch core portions 74 are spaced in the paper width direction D2 and form a plurality of magnetic paths circling in the circling direction R3.

As shown in FIG. 2, the pair of side core portions 76 form magnetic paths between the heating rotating belt 9*a* and the arch core portions 74 in the circling direction R3 of the magnetic paths. The pair of side core portions 76 are disposed so as to adjoin the plurality of arch core portions 74 in the circling direction R3 of the magnetic paths.

The pair of side core portions 76 are disposed in the vicinity of the outer periphery 711B of the induction coil 71. The pair of side core portions 76 are disposed away from the outer circumferential surface of the heating rotating belt 9*a* by a predetermined distance so as to face the outer circumferential surface of the heating rotary belt 9*a* without sandwiching the induction coil 71 therebetween.

The pair of side core portions 76 have a substantially rectangular parallelepiped shape that is elongated in the paper width direction D2, and are longer than the maximum paper-passing region 901.

Next, the belt guide member 91 according to this illustrative embodiment will be described in detail. As shown in FIG. 2 and FIG. 3, the belt guide member 91 is disposed on the inner surface of the heating rotating belt 9*a* in the radial direction of the heating rotating belt 9*a*. The belt guide member 91 is disposed on the inner surface of the heating rotating belt 9*a* and along the heating rotating belt 9*a*.

The belt guide member 91 is cylindrical, and is annular as viewed from the paper width direction D2 as shown in FIG. 2. As shown in FIG. 3, the belt guide member 91 is elongated in the paper width direction D2, and is longer than the maximum paper-passing region 901. The belt guide member 91 is in contact with at least part of the inner circumferential surface of the heating rotating belt 9*a*, positions the heating rotating belt 9*a* relative to the induction coil 71, and guides the rotation of the heating rotating belt 9*a* rotating about the first rotational axis J1.

The belt guide member 91 is rotatable about the first rotational axis J1 of the heating rotating belt 9*a* (the belt guide member 91 is rotatable both clockwise and counterclockwise as indicated by the double-headed arrow in the belt guide member of FIG. 2). A supporting rotating plate (not shown) fixed to an end of the belt guide member 91 is rotationally driven by a guide rotating portion (not shown), and thereby the belt guide member 91 is rotated.

In this embodiment, the belt guide member 91 includes an inner cylindrical portion 92 and an outer cylindrical portion 93. The inner cylindrical portion 92 and the outer cylindrical portion 93 are cylindrical. The inner cylindrical portion 92 and the outer cylindrical portion 93 are formed as a unit (e.g., formed integrally, or formed separately and then joined), with the outer circumferential surface of the inner cylindrical portion 92 joined (e.g., irremovably joined, or removably joined) to the inner circumferential surface of the outer cylindrical portion 93.

The inner cylindrical portion 92 is the inner cylindrical part of the belt guide member 91. The inner cylindrical portion 92 is formed mainly of a magnetic core formed by sintering ferrite powder which is a ferromagnetic material.

In the induction coil 71 side part (the upper part) of the inside of the heating rotating belt 9*a*, the inner cylindrical portion 92 forms magnetic paths of the magnetic flux generated by the induction coil 71 and penetrating the heating rotating belt 9*a* and the outer cylindrical portion 93. Inside the heating rotating belt 9*a*, the inner cylindrical portion 92 is disposed parallel to the center core portion 73 and the side core portions 76 and forms the magnetic paths between the center core portion 73 and the side core portions 76 (see FIG. 2).

The outer cylindrical portion 93 is the outer cylindrical part of the belt guide member 91. The outer cylindrical portion 93 is disposed on the outer side of the inner cylindrical portion 92 so as to cover the outer circumferential surface of the inner cylindrical portion 92.

The outer cylindrical portion 93 includes a coil side section 94 and a nip side section 95.

The coil side section 94 is a semi-cylindrical section of the outer cylindrical portion 93 toward the induction coil 71 relative to the first rotational axis J1 (an upper part). The nip side section 95 is a semi-cylindrical section of the outer cylindrical portion 93 toward the pressing roller 9*b* relative to the first rotational axis J1 (a lower part).

As shown in FIG. 4 and FIG. 5, the coil side section 94 includes a coil side section A1 corresponding to paper T having the maximum length in the paper width direction D2, a coil side section B1 corresponding to paper T having the intermediate length in the paper width direction D2, and a coil side section C1 corresponding to paper T having the minimum length in the paper width direction D2. The coil side section A1, B1 and C1 have predetermined widths in the rotation direction R1 of the heating rotating belt 9*a*, and are disposed throughout the entire region of the coil side section 94 in the paper width direction D2.

The coil side section A1, B1 and C1 are arranged side by side along the rotation direction R1 of the heating rotating belt 9*a*, and are disposed continuously in the order of the coil side section C1, B1 and A1 from the upstream side to the downstream side in the rotation direction R1 of the heating rotating belt 9*a*.

The belt guide member 91 can be moved to a position corresponding to the size of paper T by being rotated by the guide rotating portion (not shown). Specifically, the belt guide member 91 can be switched between a position where the coil side section A1 faces the facing surface 731 (see FIG. 2) of the center core portion 73, a position where the coil side section B1 faces the facing surface 731, and a position where the coil side section C1 faces the facing surface 731.

The coil side section A1 is a section that faces the facing surface 731 of the center core portion 73 when the paper T having the maximum length in the paper width direction D2 is transported to the fixing nip F. The coil side section B1 is a section that faces the facing surface 731 when the paper T having the intermediate length in the paper width direction D2 is transported to the fixing nip F. The coil side section C1 is a section that faces the facing surface 731 when the paper T having the minimum length in the paper width direction D2 is transported to the fixing nip F.

As shown in FIG. 5, coil side section A1 includes a temperature-rise corresponding portion 941*a* corresponding to the maximum paper-passing region and shielding portions 941*d* corresponding to the maximum non paper-passing region disposed on the outer side of the temperature-rise corresponding portion 941*a* in the paper width direction D2 (that is: in a width direction of the heating rotating belt 9*a*). The coil side section B1 includes a temperature-rise corresponding portion 942*a* corresponding to the intermediate paper-passing region and shielding portions 942*d* corresponding to the intermediate paper-passing region disposed on the outer side of the temperature-rise corresponding portion 942*a* in the paper width direction D2. The coil side section C1 includes a temperature-rise corresponding portion 943*a* corresponding to the minimum paper-passing region and minimum non paper-passing region shielding portions 943*d* corresponding to the minimum non paper-passing region disposed on the outer side of the temperature-rise corresponding portion 943*a* in the paper width direction D2.

In this embodiment, the temperature-rise corresponding portions 941*a*, 942*a*, and 943*a* are formed of a non-magnetic material such as a heat-resistant resin material, for example, a polyamide-imide resin. Thus, the magnetic flux generated by the induction coil 71 and penetrating the heating rotating belt 9*a* penetrates the temperature-rise corresponding portions 941*a*, 942*a*, and 943*a* and reaches the inner cylindrical portion 92. Since the inner cylindrical portion 92 is formed of magnetic material, the magnetic flux penetrating the heating rotating belt 9*a* and the temperature-rise corresponding portions 941*a*, 942*a*, and 943*a* passes along the inner cylindrical portion 92.

The shielding portions 941*d*, 942*d*, and 943*d* reduce or shield the magnetic flux generated by the induction coil 71. In corresponding non paper-passing regions of the heating rotating belt 9*a*, the amount of magnetic flux from the induction coil 71 passing therethrough is reduced compared to the paper-passing regions, and temperature rise in the non paper-passing regions hardly occurs or does not occur. Thus, shielding portions 941*d*, 942*d*, and 943*d* function as non temperature-rise corresponding portions. As shown in FIG. 5, the shielding portions 943*d*, 942*d*, and 941*d* are continuous in this order from the upstream side in the rotation direction R1 of the heating rotating belt 9*a*. The shielding portions 943*d*, 942*d*, and 941*d* are disposed in a staircase pattern having predetermined lengths in the paper width direction D2 as a whole.

The shielding portions 941*d*, 942*d*, and 943*d* are formed of a non-magnetic highly conductive material, for example, oxygen-free copper.

By an induced current due to penetration of magnetic flux perpendicular to the surfaces of the shielding portions 941*d*, 942*d*, and 943*d*, the shielding portions 941*d*, 942*d*, and 943*d* generate magnetic flux in a direction opposite to that of the penetrating magnetic flux. By generating magnetic flux that cancels the interlinkage magnetic flux (perpendicular penetrating magnetic flux), the shielding portions 941*d*, 942*d*, and 943*d* reduce or shield the magnetic flux that passes through the magnetic paths.

Parts of the heating rotating belt 9*a* in contact with the outer surfaces of the temperature-rise corresponding portions 941*a*, 942*a*, and 943*a* generate heat, and the temperature thereof rises. Thus, the temperature-rise corresponding portions 941*a*, 942*a*, and 943*a* function as temperature-rise corresponding portions.

As shown in FIG. 4 and FIG. 6, the nip side section 95 includes a nip side section A2 corresponding to paper T having the maximum length in the paper width direction D2, a nip side section B2 corresponding to paper T having the intermediate length in the paper width direction D2, and a nip side section C2 corresponding to paper T having the minimum length in the paper width direction D2, which are disposed continuously in the order of the nip side section C2, the nip side section B2, and the nip side section A2 from the upstream side to the downstream side in the rotation direction R1 of the heating rotating belt 9*a*.

The nip side section A2, B2, and C2 correspond to the coil side section A1, B1, and C1, respectively.

Specifically, as shown in FIG. 4, the nip side section A2, B2, and C2 are disposed across the first rotational axis J1 of the heating rotating belt 9*a* from the coil side section A1, B1, and C1, respectively. Thus, when the coil side section A1, the coil side section B1, or the coil side section C1 face the facing surface 731 (see FIG. 2) of the center core portion 73, the nip side section A2, the nip side section B2, or the nip side section C2, respectively, face the pressing roller 9*b* and form the fixing nip F.

As shown in FIG. 6, the nip side section A2 includes a maximum paper-passing corresponding portion 951*a* corresponding to the maximum paper-passing region, and outer side portions 951*d* corresponding to the maximum non paper-passing region disposed on the outer side of the maximum paper-passing corresponding portion 951*a* in the paper width direction D2 (that is: in the width direction of the heating rotating belt 9*a*). The nip side section B2 includes an intermediate paper-passing corresponding portion 952*a* corresponding to the intermediate paper-passing region, and outer side portions 952*d* corresponding to the intermediate non paper-passing region disposed on the outer side of the intermediate paper-passing corresponding portion 952*a* in the paper width direction D2. The nip side section C2 includes a minimum paper-passing corresponding portion 953*a* corresponding to the minimum paper-passing region, and outer side portions 953*d* corresponding to the minimum non paper-passing region disposed on the outer side of the minimum paper-passing corresponding portion 953*a* in the paper width direction D2.

The maximum paper-passing corresponding portion 951*a* forms the fixing nip F when the paper T having the maximum length in the paper width direction D2 is transported to the fixing nip F. The intermediate paper-passing corresponding portion 952*a* forms the fixing nip F when the paper T having the intermediate length in the paper width direction D2 is transported to the fixing nip F. The minimum paper-passing corresponding portion 953*a* forms the fixing nip F when the paper T having the minimum length in the paper width direction D2 is transported to the fixing nip F.

The maximum paper-passing corresponding portion 951*a*, the intermediate paper-passing corresponding portion 952*a*, and the minimum paper-passing corresponding portion 953*a* correspond to the temperature-rise corresponding portion 941*a*, 942*a*, and 943*a*, respectively. The maximum paper-passing corresponding portion 951*a*, the intermediate paper-passing corresponding portion 952*a*, and the minimum paper-passing corresponding portion 953*a* correspond to the maximum paper-passing region 901, the intermediate paper-passing region 902, and the minimum paper-passing region 903, respectively, of the heating rotating belt 9*a*. The lengths of the paper-passing corresponding portions 951*a*, 952*a*, and 953*a* in the paper width direction D2 are approximately the same as the lengths of the corresponding portions 941*a*, 942*a*, and 943*a*, respectively, in the paper width direction D2. The outer side portions 951*d*, 952*d*, and 953*d* correspond to the shielding portions 941*d*, 942*d*, and 943*d*, respectively.

As shown in FIG. 6, the outer side portions 953*d*, outer side portions 952*d*, and the outer side portions 951*d* are continuous in this order from the upstream side in the rotation direction R1 of the heating rotating belt 9*a*. The outer side portions 953*d*, 952*d*, and 951*d* are disposed in a staircase pattern having predetermined lengths in the paper width direction D2 as a whole.

As shown in FIG. 6, the nip side section 95 includes a nip region upstream section 954. The nip region upstream section 954 is located on the upstream side of the nip side section C2 in the rotation direction R1 of the heating rotating belt 9*a* and is continuous with the nip side section C2. The nip region upstream section 954 has a predetermined width in the rotation direction R1 of the heating rotating belt 9*a* and a length equal to the entire width of the nip side section 95 in the paper width direction D2.

The outer side portions 951*d*, the outer side portions 952*d*, and the outer side portions 953*d* and the nip region upstream section 954 are disposed continuously and have high thermal conductivity. Thus, the outer side portions 951*d*, 952*d*, 953*d*, and the nip region upstream section 954 function as a heat transfer portion 955 where heat moves from the high temperature side to the low temperature side rapidly.

Specifically, the heat transfer portion 955 has thermal conductivity higher than that of the paper-passing corresponding portions 951*a*, 952*a*, and 953*a*. The thermal conductivity of the heat transfer portion 955 is, in accordance with some embodiments, preferably about 80 W/mK or more. In some embodiments, the material of the heat transfer portion 955 is preferably metal such as iron (thermal conductivity: 84 W/mK), aluminum (thermal conductivity: 236 W/mK), or copper (thermal conductivity: 398 W/mK). The material of the paper-passing corresponding portions 951*a*, 952*a*, and 953*a* (having, as noted, thermal conductivity lower than that of the heat transfer portion 955) is, in some embodiments, preferably an elastic material, for example, silicone rubber (thermal conductivity: 0.16 W/mK).

In the illustrative embodiment, the heat transfer portion 955 is configured as follows. Since the nip side section A2, the nip side section B2, or nip side section C2 is positioned so as to form the fixing nip F, the heat transfer portion 955 also extends to the upstream side of the fixing nip F (see FIG. 2) in the rotation direction R1 of the heating rotating belt 9*a*. Parts of the heat transfer portion 955 extending to the upstream side of the fixing nip F in the rotation direction R1 of the heating rotating belt 9*a* extend to the inner side in the paper width direction D2. The parts of the heat transfer portion 955 extending to the inner side in the paper width direction D2 extend from both outer sides to the inner side in the paper width direction D2 and are joined to each other in the nip region upstream section 954.

Specifically, as shown in FIG. 6, the heat transfer portion 955 includes a portion disposed in a region corresponding to the non paper-passing regions of the heating rotating belt 9*a*, that is, a portion including the outer side portions 951*d*, 952*d*, and 953*d*, and includes the nip region upstream section 954.

The outer side portions 952*d* transfer the heat transferred from the outer side portions 951*d*, to the upstream side in the rotation direction R1 of the heating rotating belt 9*a*. The outer side portions 953*d* transfer the heat transferred from the outer side portions 951*d* and the 952*d*, to the upstream side in the rotation direction R1 of the heating rotating belt 9*a*. The nip region upstream section 954 transfers the heat of the non paper-passing regions transferred from the outer side portions 951*d*, 952*d*, and 953*d*, to the upstream side in the rotation direction R1 of the heating rotating belt 9*a*.

The outer side portions 952*d*, 953*d*, and the nip region upstream section 954 extend further to the inner side in the paper width direction D2 than the outer side portions 951*d*, 952*d*, and 953*d*, respectively, disposed adjacent to the downstream side thereof in the rotation direction R1 of the heating rotating belt 9*a*. Thus, the outer side portions 952*d* and 953*d*, and the nip region upstream section 954 transfer the heat of the non paper-passing regions of the heating rotating belt 9*a* from the downstream side to the upstream side in the rotation direction R1 of the heating rotating belt 9*a*, and transfer the heat transferred to the upstream side also to the inner side in the paper width direction D2.

The nip region upstream section 954 is disposed throughout the entire region in the paper width direction D2. Thus, the nip region upstream section 954 transfers the heat transferred from the outer side portions 951*d*, 952*d*, and 953*d* in the paper width direction D2 so that the heat is uniformly distributed in the paper width direction D2 on the upstream side of the fixing nip F. On the upstream side of the fixing nip F in the rotation direction R1 of the heating rotating belt 9*a*, the nip region upstream section 954 is in contact with the heating rotating belt 9*a* as described above. Thus, the nip region upstream section 954 transfers the heat transferred so as to be uniformly distributed in the paper width direction D2, to the heating rotating belt 9*a*. Thus, non-uniformity in the temperature distribution of the heating rotating belt 9*a* in the paper width direction D2 can be suppressed.

In this illustrative embodiment, the paper-passing corresponding portions 951*a*, 952*a*, and 953*a* are formed of an elastic material. The material of the paper-passing corresponding portions 951*a*, 952*a*, and 953*a* is, for example, an elastic material such as silicone rubber. Thus, the width of the fixing nip F in the transport direction D1 of paper T can be secured, and the pressure during the fixing can be stabilized.

The temperature sensor 96 detects the temperature of the outer circumferential surface of the heating rotating belt 9*a*. The temperature sensor 96 is disposed so as to face the outer circumferential surface of the heating rotating belt 9*a* in a non-contact state.

Next, the operation of the printer 1 including the fixing device 9 of this embodiment will be described.

When the printer 1 is ON, a receiving portion (not shown) of the printer 1 receives image formation instruction information including size information on paper T on which an image is formed generated on the basis of the operation of an operating portion (not shown) disposed outside the printer 1.

On the basis of received size information on paper T, the belt guide member 91 is rotated such that the coil side section A1, the coil side section B1, or the coil side section C1 faces the facing surface 731 of the center core portion 73, and the nip side section A2, the nip side section B2, or the nip side section C2 faces the pressing roller 9*b*, or the rotational position is maintained without rotating the belt guide member 91.

For example, when an instruction to perform printing on intermediate size paper T is received, the guide rotating portion (not shown) is controlled with reference to a storage portion (not shown), and the coil side section B1 is moved so as to face the facing surface 731 of the center core portion 73. At the same time, the nip side section B2 is moved so as to face the pressing roller 9*b*.

Next, the printer 1 starts a printing operation.

When supplying power to a drive control portion (not shown) is started, the pressing roller 9*b* is rotationally driven by the rotationally driving portion (not shown). The heating rotating belt 9*a* is rotationally driven by the rotation of the pressing roller 9*b*.

Next, the fixing device 9 starts a heat generating operation. An alternating current is applied to the induction coil 71 from the induction heating circuit portion (not shown). The induction coil 71 generates magnetic flux for causing the heating rotating belt 9*a* to generate heat.

As shown in FIG. 2, part of the magnetic flux generated by the induction coil 71 penetrates the heating rotating belt 9*a* and the outer cylindrical portion 93 and is guided to the inner cylindrical portion 92, and another part of the magnetic flux that does not penetrate the heating rotating belt 9*a* is guided along the heating rotating belt 9*a*.

The part of the magnetic flux guided along the heating rotating belt 9*a* and the part of the magnetic flux guided to the inner cylindrical portion 92 pass through the heating rotating belt 9*a* and the inner cylindrical portion 92, respectively, and are merged in the side core portions 76.

Since the magnetic flux that passes along the magnetic paths changes in magnitude and direction, an eddy current (induced current) is generated by electromagnetic induction in the substrate of the heating rotating belt 9*a* positioned at the vertically upper part of the rotating heating rotating belt 9*a*. The eddy current flows in the substrate of the heating rotating belt 9*a*, and Joule heat is generated with the electrical resistance of the substrate of the heating rotating belt 9*a*.

In the non paper-passing regions of paper T, the magnetic flux generated by the induction coil 71 and penetrating the substrate of the heating rotating belt 9*a* passes through the shielding portions 942*d* (see FIG. 5) of the coil side section 94 of the outer cylindrical portion 93 before reaching the inner cylindrical portion 92. By an induced current due to penetration of magnetic flux perpendicular to the surface of the shielding portions 942*d*, the shielding portions 942*d* generate magnetic flux in a direction opposite to that of the penetrating magnetic flux.

By generating magnetic flux that cancels the interlinkage magnetic flux (perpendicular penetrating magnetic flux), the shielding portions 942*d* reduce or shield the magnetic flux that passes along the magnetic paths. Thus, the magnetic flux passing through the inner cylindrical portion 92 is reduced or shielded.

Thus, the amount of the magnetic flux passing through the inner cylindrical portion 92 is smaller than that in the case where the shielding portions 942*d* are not provided. The magnetic flux that is reduced or shielded by the shielding portions 942*d* and that passes through the shielding portions 942*d* merges into the side core portions 76.

Next, with the rotation of the heating rotating belt 9*a*, part of the heating rotating belt 9*a*, that is caused to generate heat by electromagnetic induction heating, is moved toward the fixing nip F formed by the heating rotating belt 9*a* and the pressing roller 9*b* of the fixing device 9. The fixing device 9 controls the induction heating circuit portion (not shown) such that a temperature of the fixing nip is caused to reach a predetermined temperature.

The paper T on which a toner image is formed is introduced to the fixing nip F of the fixing device 9. At the fixing nip F, toner forming the toner image transferred to the paper T is fused and fixed to the paper T.

In the paper-passing region through which the paper T passes, the paper T comes into contact with the outer circumferential surface of the heating rotating belt 9*a*, and thereby heat is taken from the heating rotating belt 9*a*. On the other hand, in the non paper-passing regions through which the paper T does not pass, the paper T does not come into contact with the outer circumferential surface of the heating rotating belt 9*a*, and thus the temperature of the heating rotating belt 9*a* may rise excessively. Particularly in the case where printing is continuously performed on small size paper T, the non paper-passing regions are wide. In the wide non paper-passing regions, the temperature of the heating rotating belt 9*a* is prone to rise excessively.

That is, in the case where printing is continuously performed on small size paper T, the temperature of the heating rotating belt 9*a* is prone to be high at both ends in the paper width direction D2 and is prone to be low in the center in the paper width direction D2.

In this embodiment, the belt guide member 91 includes the heat transfer portion 955. Since the nip side section A2, B2, or C2 is positioned so as to form the fixing nip F, the heat transfer portion 955 also extends to the upstream side of the fixing nip F in the rotation direction R1 of the heating rotating belt 9*a*. The thermal conductivity of the heat transfer portion 955 is higher than that of the paper-passing corresponding portions 951*a*, 952*a*, and 953*a*. Thus, the heat at both ends in the paper width direction D2 (that is, the heat in the non paper-passing regions) is transferred to the upstream side of the fixing nip F in the rotation direction R1 of the heating rotating belt 9*a*. Thus, in accordance with the illustrative embodiment, the temperature of the non paper-passing regions of the heating rotating belt 9*a* can be prevented from rising excessively.

The heat transfer portion 955 extends to the inner side in the paper width direction D2 on the upstream side of the fixing nip F in the rotation direction R1 of the heating rotating belt 9*a*. Thus, the heat transferred to the upstream side in the rotation direction R1 of the heating rotating belt 9*a* is transferred to the inner side of the heat transfer portion 955 in the paper width direction D2. Thus, the temperature of the non paper-passing regions of the heating rotating belt 9*a* can be prevented from rising excessively.

The heat transfer portion 955 has a nip region upstream section 954 on the upstream side of the fixing nip F in the rotation direction R1 of the heating rotating belt 9*a*. Thus, the heat transferred to the nip region upstream section 954 is transferred so as to be uniformly distributed in the paper width direction D2 of the nip region upstream section 954. Since the nip region upstream section 954 is in contact with the heating rotating belt 9*a*, the heat of the nip region upstream section 954 is transferred to the heating rotating belt 9*a*. Thus, non-uniformity in the temperature distribution of the heating rotating belt 9*a* in the paper width direction D2 can be reduced. Accordingly, it is understood that according to the illustrative embodiment, when printing is performed on large size paper T after printing is performed on small size paper T, the occurrence of image offset can be reduced, and the occurrence of defective image formation can be reduced.

The printer 1 of the first embodiment has, for example, the following illustrative advantageous features and effects.

The printer 1 of the first embodiment includes a pressing roller 9*b*, a heating rotating belt 9*a*, an induction coil 71, a magnetic core portion 72, and a belt guide member 91. The heating rotating belt 9*a* is disposed so as to face the pressing roller 9*b*, and is rotationally driven by the rotation of the pressing roller 9*b*. The magnetic core portion 72 forms magnetic paths of magnetic flux generated by the induction coil 71. The belt guide member 91 is disposed on the inner side of the heating rotating belt 9*a* and guides the rotation of the heating rotating belt 9*a*. The belt guide member 91 includes a coil side section 94 and a nip side section 95. The coil side section 94 is disposed on the induction coil 71 side and includes corresponding portions (temperature-rise corresponding portions) 941*a*, 942*a*, and 943*a* and shielding portions (non temperature-rise corresponding portions) 941*d*, 942*d*, and 943*d*. The nip side section 95 is disposed on the pressing roller 9*b* side and includes paper-passing corresponding portions 951*a*, 952*a*, and 953*a* corresponding to paper-passing regions through which paper T passes, and heat transfer portion 955 that is disposed in a region including regions corresponding to the non paper-passing regions and that has thermal conductivity higher than that of the paper-passing corresponding portions 951*a*, 952*a*, and 953*a*.

Thus, the heat of the non paper-passing regions of the heating rotating belt 9*a* in the paper width direction D2 is transferred to the heat transfer portion 955 of the nip side section 95 of the belt guide member 91. Thus, the temperature of the non paper-passing regions of the heating rotating belt 9*a* can be prevented from rising excessively.

In the printer 1 of the first embodiment, the heat transfer portion 955 extends to the upstream side of the fixing nip F in the rotation direction R1 of the heating rotating belt 9*a*. Thus, the heat of the non paper-passing regions of the heating rotating belt 9*a* in the paper width direction D2 is transferred by the heat transfer portion 955 to the upstream side in the rotation direction R1 of the heating rotating belt 9*a*. Thus, the temperature of the non paper-passing regions of the heating rotating belt 9*a* can be prevented from rising excessively.

In the printer 1 of the first embodiment, parts of the heat transfer portion 955 extending to the upstream side of the fixing nip F in the rotation direction R1 of the heating rotating belt 9*a* extend to the inner side of the heating rotating belt 9*a* in the paper width direction D2. Thus, the heat transferred to the upstream side of the fixing nip F in the rotation direction R1 of the heating rotating belt 9*a* is transferred to the inner side in the paper width direction D2. Thus, the temperature of the ends of the heating rotating belt 9*a* can be further prevented from rising excessively.

In the printer 1 of the first embodiment, the parts of the heat transfer portion 955 extending to the inner side in the width direction of the heating rotating belt 9*a* extend from both outer sides to the inner side of the heating rotating belt 9*a* in the paper width direction D2 and are joined to each other. In this embodiment, the heat transfer portion 955 includes a nip region upstream section 954 disposed on the upstream side of the fixing nip F in the rotation direction R1 of the heating rotating belt 9*a* and throughout the entire region in the paper width direction D2. Thus, the heat transferred to the nip region upstream section 954 is transferred so as to be uniformly distributed in the paper width direction D2 of the nip region upstream section 954. Thus, the temperature of the non paper-passing regions of the heating rotating belt 9*a* can be further prevented from rising excessively, and non-uniformity in the temperature distribution in the paper width direction D2 can be reduced.

The heating rotating belt 9*a* is rotationally driven by the rotation of the pressing roller 9*b*. The part of the heating rotating belt 9*a* in the upstream vicinity of the fixing nip F where the heating rotating belt 9*a* and the pressing roller 9*b* are in contact with each other is subject to a force pulling the heating rotating belt 9*a* inwardly. Thus, the inner circumferential surface of the heating rotating belt 9*a* comes into contact with the nip region upstream section 954. Thus, the heat of the nip region upstream section 954 is transferred to the heating rotating belt 9*a*. Thus, non-uniformity in the temperature distribution of the heating rotating belt 9*a* in the paper width direction D2 can be reduced.

In the printer 1 of the first embodiment, the belt guide member 91 is rotatable in the rotation direction R1 of the heating rotating belt 9*a* and the opposite direction thereof according to the size of paper T. Thus, the belt guide member 91 can be positioned at an appropriate position according to the size of paper T, and the temperature of the non paper-passing regions of the heating rotating belt 9*a* can be prevented from rising excessively.

The corresponding portions 941*a*, 942*a*, and 943*a* are disposed across the first rotational axis J1 of the heating rotating belt 9*a* from the paper-passing corresponding portions 951*a*, 952*a*, and 953*a*, respectively. Thus, the temperature-rise corresponding portion 941*a*, 942*a*, or 943*a* can be positioned so as to face the center core portion 73, and the paper-passing corresponding portion 951*a*, 952*a*, or 953*a* can be positioned so as to form the fixing nip F, at the same time. Thus, according to the size of paper T, the paper-passing region of the heating rotating belt 9*a* can be efficiently heated, and the temperature of the non paper-passing regions of the heating rotating belt 9*a* can be efficiently prevented from rising excessively.

Next, a second embodiment as another illustrative embodiment of the printer 1 of the present disclosure will be described with reference to the drawings. In the description of the second embodiment, for ease of reference and clarity of exposition, the same reference numerals will be used to designate the same components as those in the first embodiment, and the description thereof will be omitted or simplified.

Figure 7:
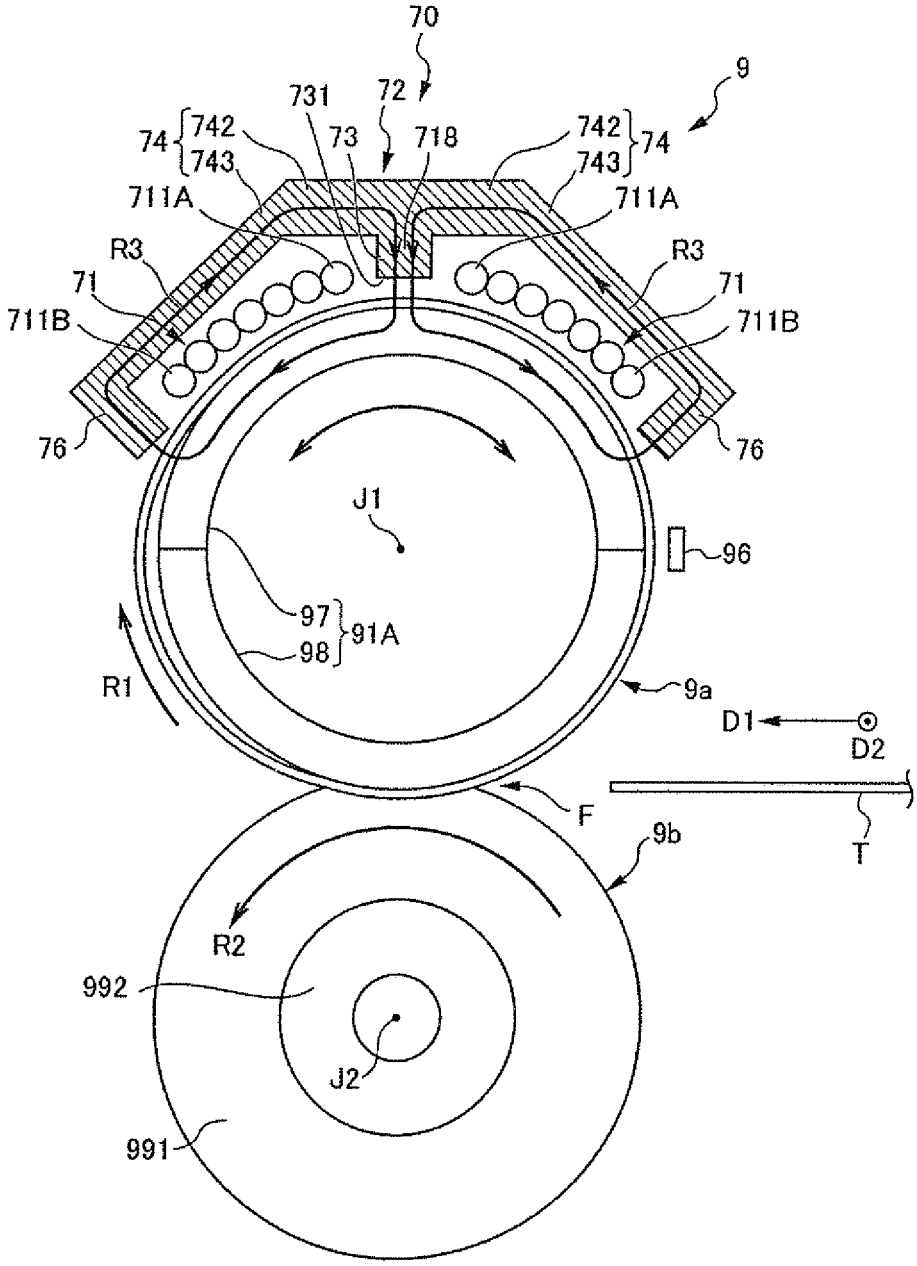
FIG. 7 is a sectional view for illustrating a fixing device of a printer of a second embodiment.
Figure 8:
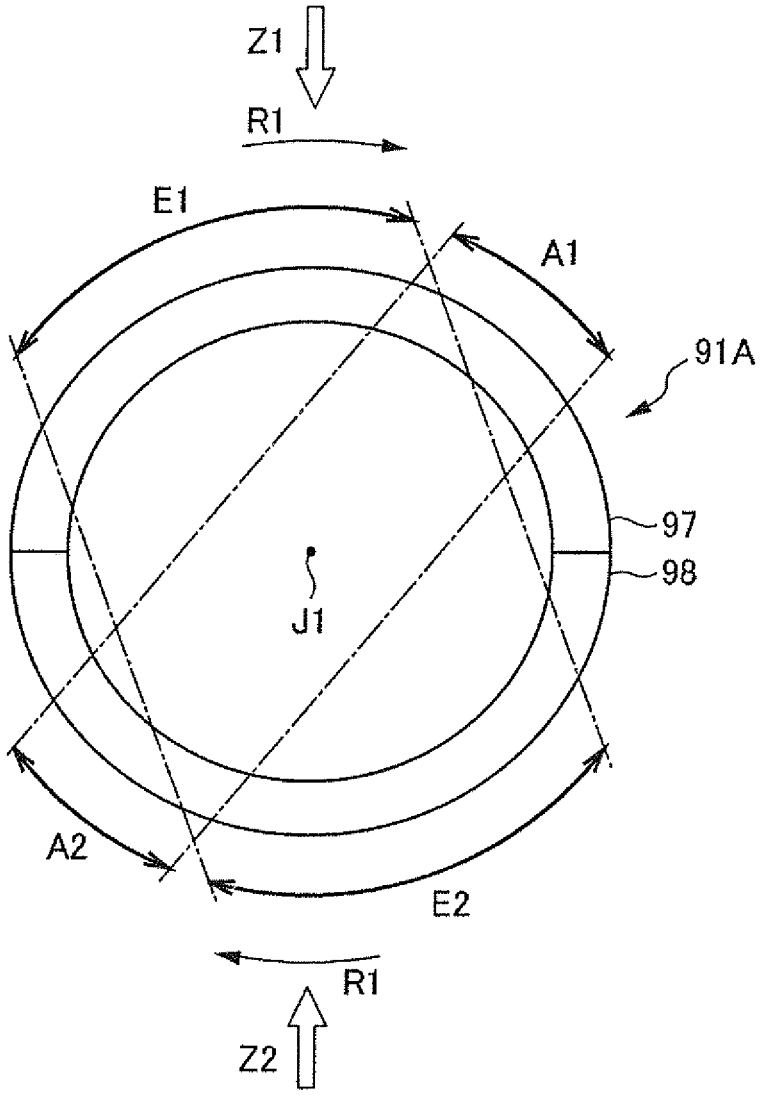
FIG. 8 is a sectional view showing the configuration of a belt guide member of the second embodiment.
Figure 9:
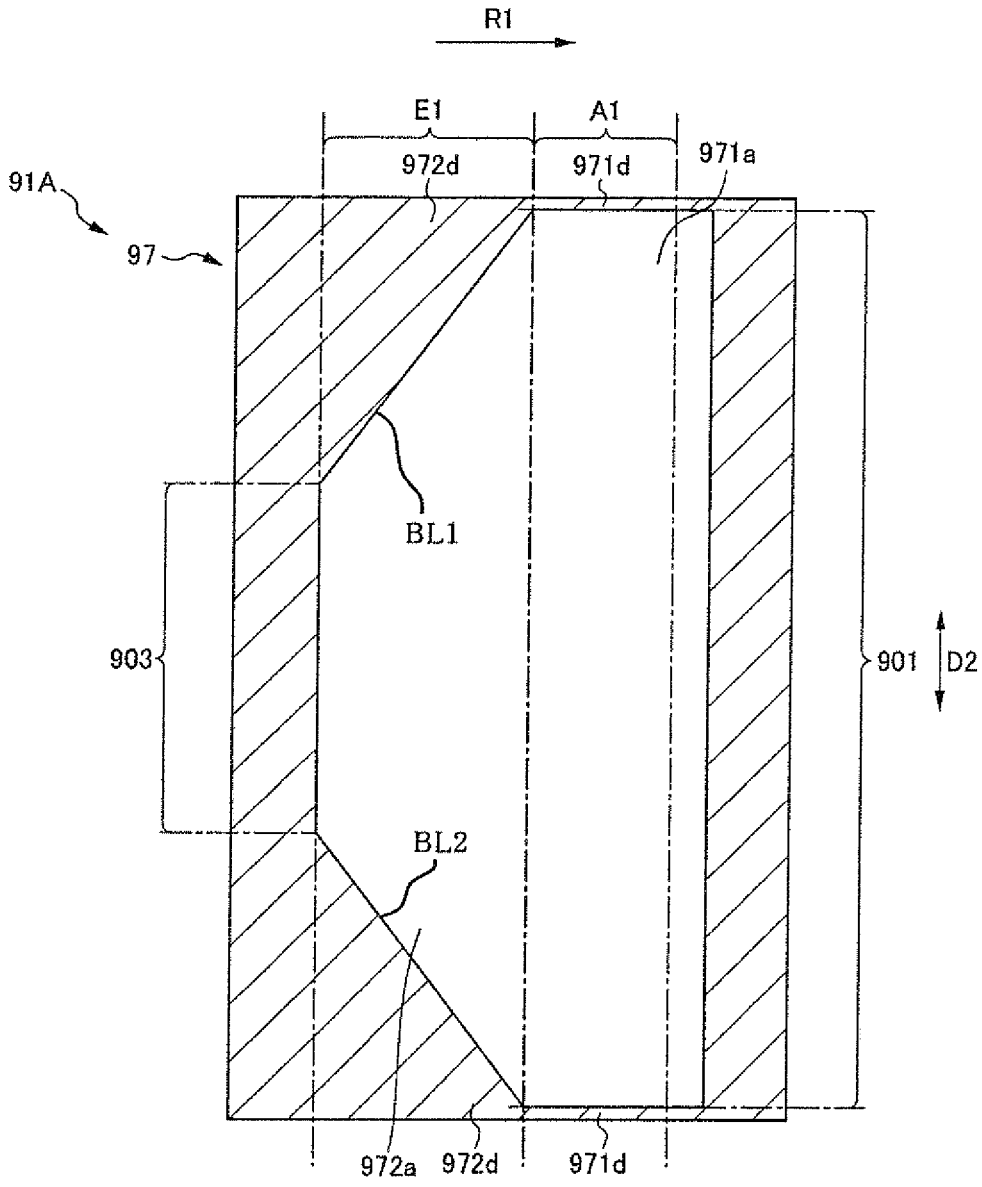
FIG. 9 illustrates the belt guide member shown in FIG. 8 viewed from a Z1 direction.
Figure 10:
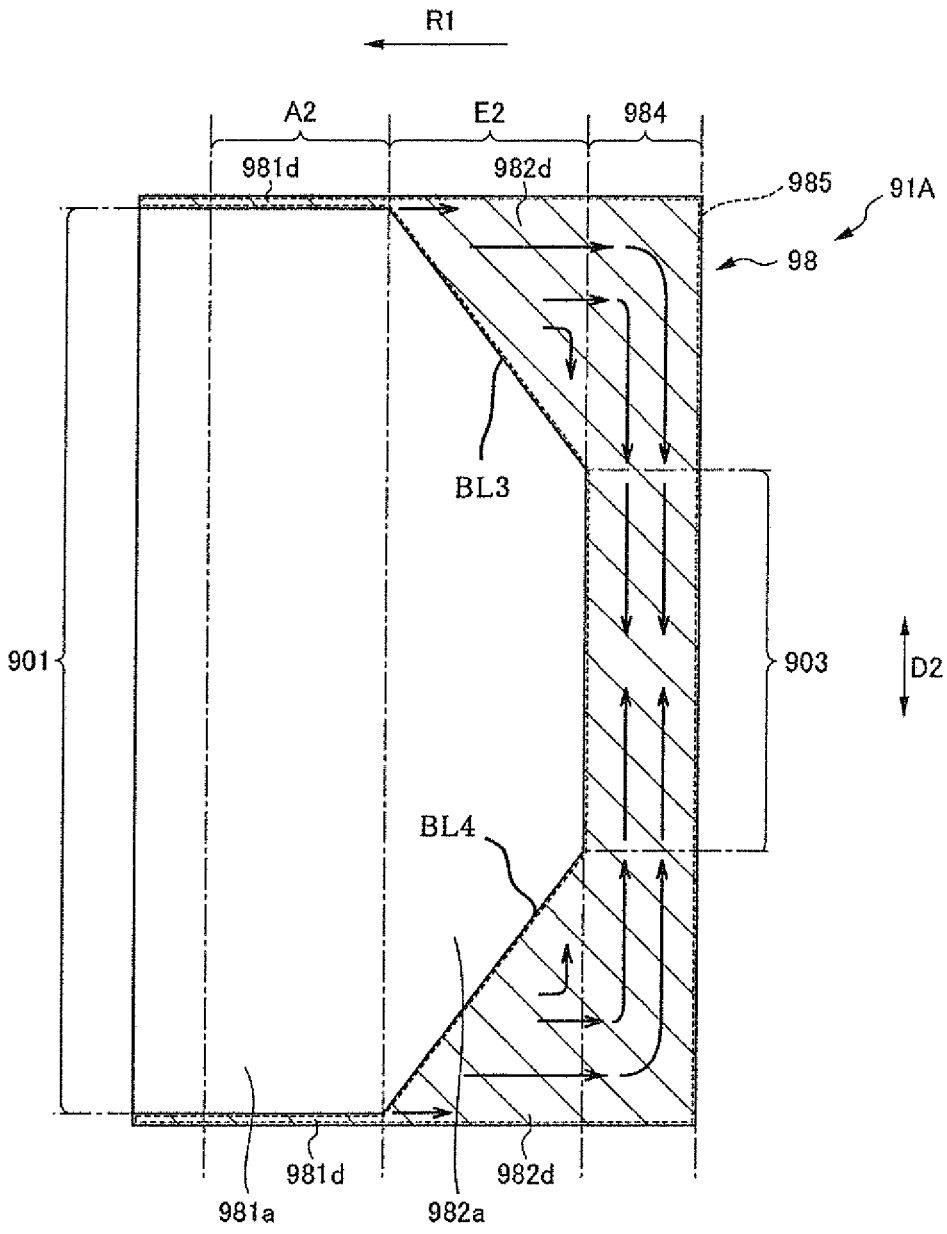
FIG. 10 illustrates the belt guide member shown in FIG. 8 viewed from a Z2 direction.

The printer 1 of the second embodiment will be described with reference to FIGS. 7 through 10. FIG. 7 is a sectional view for illustrating a fixing device 9A of the printer 1 of the second embodiment. FIG. 8 is a sectional view showing the configuration of a belt guide member 91A of the second embodiment. FIG. 9 illustrates the belt guide member 91A shown in FIG. 8 viewed from a Z1 direction. FIG. 10 illustrates the belt guide member 91A shown in FIG. 8 viewed from a Z2 direction.

The fixing device 9A of the second embodiment differs from the first embodiment in the configuration of the belt guide member 91A and the material of a substrate of the heating rotating belt 9*a*.

In this embodiment, the substrate of the heating rotating belt 9*a* is formed of polyimide (PI). Since the substrate of the heating rotating belt 9*a* is formed of polyimide (PI), which is a resin material, the heating rotating belt 9*a* does not form magnetic paths of magnetic flux and does not generate heat when magnetic flux generated by the induction coil 71 passes through the heating rotating belt 9*a*.

The belt guide member 91A is cylindrical as shown in FIG. 7 and FIG. 8. The belt guide member 91A includes a semi-cylindrical coil side section 97 disposed toward the induction coil 71 relative to the first rotational axis J1, and a semi-cylindrical nip side section 98 disposed toward the pressing roller 9*b* relative to the first rotational axis J1. The fixing device 9A of the second embodiment has no counterpart to the inner cylindrical portion 92 of the first embodiment.

As shown in FIG. 8 and FIG. 9, the coil side section 97 includes a coil side section A1 corresponding to the maximum paper-passing region and a non-step coil side section E1. The maximum paper passing coil side section A1 and the non-step coil side section E1 have predetermined widths in the rotation direction R1 of the heating rotating belt 9*a* and are disposed throughout the entire region of the coil side section 94 in the paper width direction D2.

The coil side section A1 and the non-step coil side section E1 are arranged side by side along the rotation direction R1 of the heating rotating belt 9*a*. That is, the non-step coil side section E1 and the coil side section A1 are disposed continuously in order from the upstream side in the rotation direction R1 of the heating rotating belt 9*a*.

The coil side section A1 includes a heat-generating portion 971*a* corresponding to the maximum paper-passing region 901, and non heat-generating portions 971*d* corresponding to the maximum non paper-passing region 901*d* (see FIG. 2) on the outer side of the heat-generating portion 971*a* in the paper width direction D2. The non-step coil side section E1 includes a heat-generating portion 972*a* of a non-step paper-passing region, and non heat-generating portions 972*d* of a non-step non paper-passing region on the outer side of the heat-generating portion 972*a* in the paper width direction D2.

The border lines (BL1 or BL2) between the heat-generating portion 972*a* and the non heat-generating portions 972*d* are inclined to the rotation direction R1 of the heating rotating belt 9*a* in a non-step manner (linearly in this embodiment). Specifically, the border lines (BL1 or BL2) between the heat-generating portion 972*a* and the non heat-generating portions 972*d* are straight lines connecting points corresponding to the ends of the minimum paper-passing region 903 in the paper width direction D2 in the upstream end of the non-step coil side section E1 in the rotation direction R1 of the heating rotating belt 9*a*, and points corresponding to the ends of the maximum paper-passing region 901 in the paper width direction D2 in the downstream end of the non-step coil side section E1 in the rotation direction R1 of the heating rotating belt 9*a*.

The heat-generating portion 971*a* and 972*a* are formed of magnetic material. Thus, in the heat-generating portion 971*a* and 972*a*, an eddy current (induced current) is generated by electromagnetic induction due to magnetic flux passing through them. The eddy current flows in the heat-generating portion 971*a* and 972*a*, and Joule heat is generated with the electrical resistance of the heat-generating portion 971*a* and 972*a*. In this way, the heat-generating portion 971*a* and 972*a* are caused to generate heat by electromagnetic induction heating (IH) utilizing electromagnetic induction due to the magnetic flux from the heating unit 70.

The heat-generating portion 971*a* and 972*a* function as temperature-rise corresponding portions.

The non heat-generating portions 971*d* and 972*d* are formed of non-magnetic material. The non heat-generating portions 971*d* and 972*d* function as non temperature-rise corresponding portions.

The belt guide member 91A is positioned at a position corresponding to the size of paper T by being rotated by a guide rotating portion (not shown). Specifically, the belt guide member 91A can be switched between a position where the maximum paper passing coil side section A1 faces the facing surface 731 (see FIG. 7) of the center core portion 73 and a position where the non-step coil side section E1 faces the facing surface 731 of the center core portion 73.

The width of the heat-generating portion 972*a* in the paper width direction D2 changes in a non-step manner. Thus, by adjusting the rotation angle of the belt guide member 91A and changing the position of the heat-generating portion 972*a* facing the facing surface 731 of the center core portion 73, various sizes of paper T (from paper T having the maximum length in the paper width direction D2 to paper T having the minimum length in the paper width direction D2) can be dealt with.

As shown in FIG. 8 and FIG. 10, the nip side section 98 includes a nip side section A2 corresponding to the maximum paper-passing region 901 and a non-step nip side section E2. The nip side section A2 and the non-step nip side section E2 are arranged side by side along the rotation direction R1 of the heating rotating belt 9*a*. That is, the non-step nip side section E2 and the nip side section A2 are disposed continuously in order from the upstream side in the rotation direction R1 of the heating rotating belt 9*a*.

The nip side section A2 and the non-step nip side section E2 correspond to the coil side section A1 and the non-step coil side section E1, respectively. Specifically, as shown in FIG. 8, the nip side section A2 and the non-step nip side section E2 are disposed across the first rotational axis J1 of the heating rotating belt 9*a* from the coil side section A1 and the non-step coil side section E1, respectively. Thus, when the coil side section A1 or the non-step coil side section E1 face the facing surface 731 (see FIG. 7) of the center core portion 73, the nip side section A2 or the non-step nip side section E2, respectively, face the pressing roller 9*b* and form the fixing nip F.

As shown in FIG. 10, the nip side section A2 includes a maximum paper-passing corresponding portion 981*a* corresponding to the maximum paper-passing region 901, and outer side portions 981*d* corresponding to the maximum non paper-passing region 901*d* (see FIG. 2) disposed on the outer side of the maximum paper-passing corresponding portion 981*a* in the paper width direction D2. The non-step nip side section E2 includes a non-step paper-passing corresponding portion 982*a*, and outer side portions 982*d* disposed on the outer side of the non-step paper-passing corresponding portion 982*a* in the paper width direction D2.

The maximum paper-passing corresponding portion 981*a* and the non-step paper-passing corresponding portion 982*a* correspond to the heat-generating portion 971*a* and the 972*a*, respectively.

The maximum paper-passing corresponding portion 981*a* and the non-step paper-passing corresponding portion 982*a* correspond to the maximum paper-passing region 901 of the heating rotating belt 9*a*, and the region from the maximum paper-passing region 901 to the minimum paper-passing region 903 of the heating rotating belt 9*a*, respectively.

As shown in FIG. 10, the outer side portions 982*d* and 981*d* are continuous in this order from the upstream side in the rotation direction R1 of the heating rotating belt 9*a*. Border lines (BL3 or BL4) between the corresponding portion 982*a* and the outer side portions 982*d* are inclined to the rotation direction R1 of the heating rotating belt 9*a* in a non-step manner (linearly in this embodiment). The lengths of the outer side portions 981*d* and 982*d* in the paper width direction D2 correspond to the lengths of the non paper-passing regions of various sizes of paper T in the paper width direction D2.

As shown in FIG. 10, the nip side section 98 includes a nip region upstream section 984. The nip region upstream section 984 is located on the upstream side of the non-step nip side section E2 in the rotation direction R1 of the heating rotating belt 9*a* and is continuous with the non-step nip side section E2. The nip region upstream section 984 has a predetermined width in the rotation direction R1 of the heating rotating belt 9*a* and a length equal to the entire width of the nip side section 98 in the paper width direction D2.

The outer side portions 981*d*, 982*d*, and the nip region upstream section 984 are disposed continuously, have high thermal conductivity, and function as a heat transfer portion 985 as with the above-described first embodiment. Since the nip side section A2 or E2 is positioned so as to form the fixing nip F, the heat transfer portion 985 extends to the upstream side of the fixing nip F in the rotation direction R1 of the heating rotating belt 9*a* as with the above-described first embodiment. Parts of the heat transfer portion 985 extending to the upstream side in the rotation direction R1 of the heating rotating belt 9*a* extend to the inner side in the paper width direction D2. The parts of the heat transfer portion 985 extending to the inner side in the paper width direction D2 extend from both outer sides to the inner side in the paper width direction D2 and are joined to each other in the nip region upstream section 984 and on the inner side in the paper width direction D2.

When the printer 1 including the fixing device 9A of the second embodiment is activated, the heating rotating belt 9*a* does not generate heat, and the heat-generating portion 971*a* or 972*a* facing the facing surface 731 of the center core portion 73 generates heat by electromagnetic induction heating utilizing electromagnetic induction. The heat generated in the heat-generating portion 971*a* or 972*a* is transferred to the heating rotating belt 9*a*. Since the non heat-generating portions 971*d* and 972*d* on the outer side of the heat-generating portions 971*a* and 972*a* are formed of non-magnetic material, the non heat-generating portions 971*d* and 972*d* do not generate heat.

Since the corresponding portion 982*a* and the heat-generating portion 972*a* corresponding to each other are formed in a non-step manner, the fixing operation can be performed according to various sizes of paper T by adjusting the rotation angle of the belt guide member 91A.

The heat of the non paper-passing regions of the heating rotating belt 9*a* can be transferred to the upstream side in the rotation direction R1 of the heating rotating belt 9*a* and can be transferred so as to be uniformly distributed in the nip region upstream section 984 in the paper width direction D2, by the heat transfer portion 985. Thus, the temperature of the non paper-passing regions of the heating rotating belt 9*a* can be prevented from rising excessively, and non-uniformity in the temperature distribution of the heating rotating belt 9*a* in the paper width direction D2 can be reduced.

The printer 1 of the second embodiment has the same illustrative advantageous features and effects as the first embodiment.

Although two embodiments have been described exemplarily, the present disclosure is not limited to the above-described embodiments and can be carried out in various forms.

The type of image forming apparatus of the present disclosure is not particularly limited. Examples of image forming apparatus may include, in addition to a printer, a copying machine, a facsimile machine, and a multifunctional peripheral having functions of them. The sheet-like receiving material is not limited to paper and may be, for example, a film sheet.

Having thus described in detail embodiments of the present disclosure, it is to be understood that the subject matter disclosed by the foregoing paragraphs is not to be limited to particular details and/or embodiments set forth in the above description. For example, particular numerical values or ranges are provided by way of illustration for clarity of exposition, and are not intended to limit the possible values or ranges that may be implemented in accordance with the present disclosure. Additionally, the present disclosure may be practiced without necessarily providing one or more of the advantages described herein or otherwise understood in view of the disclosure and/or that may be realized in some embodiments thereof. Accordingly, it is understood that many modifications and variations of the embodiments and subject matter disclosed herein are possible without departing from the scope of the present disclosure.

What is claimed is:

1. A fixing device comprising:

a pressing rotating body;

a heating rotating belt having an inner surface and an opposite outer surface, the heating rotating belt being disposed such that the outer surface faces the pressing rotating body, and being configured to form a fixing nip between the outer surface and the pressing rotating body, and to be rotationally driven about a rotational axis by the rotation of the pressing rotating body;

an induction coil disposed so as to face the outer surface of the heating rotating belt in a radial direction of the heating rotating belt and configured to generate magnetic flux;

a magnetic core portion configured to form a magnetic path of the magnetic flux generated by the induction coil; and a belt guide member disposed on the inner surface of the heating rotating belt in the radial direction of the heating rotating belt, and configured to be in contact with at least part of the inner surface of the heating rotating belt to position the heating rotating belt, and to guide the rotation of the heating rotating belt, wherein the belt guide member includes (i) a coil side section that is disposed toward the induction coil relative to the rotational axis and that includes a temperature-rise corresponding portion and a non temperature-rise corresponding portion disposed on the outer side of the temperature-rise corresponding portion in a width direction of the heating rotating belt, and (ii) a nip side section that is disposed toward the pressing rotating body relative to the rotational axis and that includes a paper-passing corresponding portion corresponding to a paper-passing region through which a receiving material passes and a heat transfer portion disposed on the outer side of the paper-passing corresponding portion in the width direction of the heating rotating belt, the heat transfer portion having thermal conductivity higher than the thermal conductivity of the paper-passing corresponding portion.

2. The fixing device according to claim 1, wherein the heat transfer portion includes a nip region upstream section extending to the upstream side of the fixing nip in the rotation direction of the heating rotating belt.

3. The fixing device according to claim 2, wherein the nip region upstream section extends to the inner side in the width direction of the heating rotating belt.

4. The fixing device according to claim 3, wherein parts of the nip region upstream section extending to the inner side in the width direction of the heating rotating belt extend from both outer sides to the inner side in the width direction of the heating rotating belt and are joined to each other.

5. The fixing device according to claim 1, wherein the belt guide member is rotatable according to the size of the receiving material.

6. The fixing device according to claim 1, wherein the length of the temperature-rise corresponding portion in the width direction of the heating rotating belt is approximately the same as the length of the paper-passing corresponding portion in the width direction of the heating rotating belt.

7. The fixing device according to claim 1, wherein the belt guide member further includes an inner cylindrical portion on the inner side of the coil side section and the nip side section, and the inner cylindrical portion forms part of the magnetic path.

8. The fixing device according to claim 1, wherein the border line between the paper-passing corresponding portion and the heat transfer portion is inclined in a non-step manner to the rotation direction of the heating rotating belt.

9. An image forming apparatus comprising:

an image bearing member on which an electrostatic latent image is formed;

a developing device configured to develop the electrostatic latent image formed on the image bearing member into a toner image;

a transfer portion configured to transfer the toner image formed on the image bearing member to a receiving material; and a fixing device configured to fix the toner image transferred to the receiving material, to the receiving material, wherein the fixing device includes a pressing rotating body;

a heating rotating belt having an inner surface and an opposite outer surface, the heating rotating belt being disposed such that the outer surface faces the pressing rotating body, and being configured to form a fixing nip between the outer surface and the pressing rotating body, and to be rotationally driven about a rotational axis by the rotation of the pressing rotating body;

an induction coil disposed so as to face the outer surface of the heating rotating belt in a radial direction of the heating rotating belt and configured to generate magnetic flux;

a magnetic core portion configured to form a magnetic path of the magnetic flux generated by the induction coil; and a belt guide member disposed on the inner surface of the heating rotating belt in the radial direction of the heating rotating belt, and configured to be in contact with at least part of the inner surface of the heating rotating belt to position the heating rotating belt, and to guide the rotation of the heating rotating belt, wherein the belt guide member includes (i) a coil side section that is disposed toward the induction coil relative to the rotational axis and that includes a temperature-rise corresponding portion and a non temperature-rise corresponding portion disposed on the outer side of the temperature-rise corresponding portion in a width direction of the heating rotating belt, and (ii) a nip side section that is disposed toward the pressing rotating body relative to the rotational axis and that includes a paper-passing corresponding portion corresponding to a paper-passing region through which a receiving material passes and a heat transfer portion disposed on the outer side of the paper-passing corresponding portion in the width direction of the heating rotating belt, the heat transfer portion having thermal conductivity higher than the thermal conductivity of the paper-passing corresponding portion.

10. The image forming apparatus according to claim 9, wherein the heat transfer portion includes a nip region upstream section extending to the upstream side of the fixing nip in the rotation direction of the heating rotating belt.

11. The image forming apparatus according to claim 10, wherein the nip region upstream section extends to the upstream side of the fixing nip in the rotation direction of the heating rotating belt and to the inner side in the width direction of the heating rotating belt.

12. The image forming apparatus according to claim 11, wherein parts of the nip region upstream section extending to the inner side in the width direction of the heating rotating belt extend from both outer sides to the inner side in the width direction of the heating rotating belt and are joined to each other.

13. The image forming apparatus according to claim 9, wherein the belt guide member is rotatable according to the size of the receiving material.

14. The image forming apparatus according to claim 9, wherein the length of the temperature-rise corresponding portion in the width direction of the heating rotating belt is approximately the same as the length of the paper-passing corresponding portion in the width direction of the heating rotating belt.

15. The image forming apparatus according to claim 9, wherein the belt guide member further includes an inner cylindrical portion on the inner side of the coil side section and the nip side section, and the inner cylindrical portion forms part of the magnetic path.

16. The image forming apparatus according to claim 9, wherein the border line between the paper-passing corresponding portion and the heat transfer portion is inclined in a non-step manner to the rotation direction of the heating rotating belt.

* * * * *